US009428994B2

(12) United States Patent
Landrith, II et al.

(10) Patent No.: US 9,428,994 B2
(45) Date of Patent: Aug. 30, 2016

(54) BLOWOUT PREVENTER MONITOR WITH TRIGGER SENSOR AND METHOD OF USING SAME

(71) Applicant: National Oilwell Varco, L.P., Houston, TX (US)

(72) Inventors: James Ray Landrith, II, Humble, TX (US); Roger Dale Brown, Katy, TX (US); Jonathan Lewis Buelow, Houston, TX (US); Joseph James Liotta, Conroe, TX (US); Eric Trevor Ensley, Cypress, TX (US); Christopher Dale Johnson, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 14/318,319

(22) Filed: Jun. 27, 2014

(65) Prior Publication Data

US 2014/0311735 A1 Oct. 23, 2014

Related U.S. Application Data

(63) Continuation-in-part of application No. 13/168,594, filed on Jun. 24, 2011, now Pat. No. 8,978,698.

(60) Provisional application No. 61/842,232, filed on Jul. 2, 2013, provisional application No. 61/360,783, filed on Jul. 1, 2010.

(51) Int. Cl.
*E21B 34/16* (2006.01)
*E21B 33/064* (2006.01)

(52) U.S. Cl.
CPC ..... *E21B 34/16* (2013.01); *E21B 33/064* (2013.01)

(58) Field of Classification Search
CPC ..... E21B 34/16; E21B 33/064; E21B 44/00
USPC ..... 137/553, 554, 556
See application file for complete search history.

(56) References Cited

U.S. PATENT DOCUMENTS 899,029 A 9/1908 Connet
2,045,760 A * 6/1936 Diescher ..... 417/7

(Continued)

OTHER PUBLICATIONS

International Search Report and Written Opinion mailed Jan. 5, 2012 for PCT/US11/41894.

(Continued)

*Primary Examiner* — Marina Tietjen
*Assistant Examiner* — Daphne M Barry
(74) *Attorney, Agent, or Firm* — JL Salazar Law Firm

(57) ABSTRACT

The present disclosure relates to a monitor for a blowout preventer of a wellbore. The blowout preventer includes a housing, rams, and an actuator comprising a cylinder with a piston. The piston is operatively connectable with the ram and movable therewith. The monitor includes a monitor base operatively connectable to the cylinder (the monitor base having an interior side inside the cylinder and an exterior side outside the cylinder), an interior plate positionable inside the cylinder about the interior side of the base (the interior plate operatively connectable to the piston and movable therewith), an exterior plate positionable outside the cylinder about the exterior surface of the monitor base (the exterior plate coupled by magnets to the interior plate and rotatable therewith), and a trigger sensor operatively connectable about the monitor base and the exterior plate to detect rotation thereof whereby a position of the ram may be determined.

33 Claims, 27 Drawing Sheets

(56) References Cited

U.S. PATENT DOCUMENTS

| | | | | |
|---|---|---|---|---|
| 4,084,671 | A | 4/1978 | Ternehall | |
| 4,213,480 | A * | 7/1980 | Orum et al. | 137/556 |
| 4,406,303 | A * | 9/1983 | Kilmoyer | 137/554 |
| 4,540,046 | A | 9/1985 | Granger et al. | |
| 4,647,002 | A | 3/1987 | Crutchfield | |
| 4,836,974 | A | 6/1989 | Ezekoye et al. | |
| 4,922,423 | A | 5/1990 | Koomey et al. | |
| 5,025,708 | A | 6/1991 | Smith et al. | |
| 5,046,376 | A * | 9/1991 | Baker | 74/89.39 |
| 5,074,518 | A | 12/1991 | Berry | |
| 5,150,049 | A | 9/1992 | Schuetz | |
| 5,320,325 | A | 6/1994 | Young et al. | |
| 5,407,172 | A | 4/1995 | Young et al. | |
| 5,575,452 | A | 11/1996 | Whitby et al. | |
| 5,655,745 | A | 8/1997 | Morrill | |
| 5,735,502 | A | 4/1998 | Levett et al. | |
| 5,897,094 | A | 4/1999 | Brugman et al. | |
| 6,173,770 | B1 | 1/2001 | Morrill | |
| 6,244,560 | B1 | 6/2001 | Johnson | |
| 6,374,925 | B1 | 4/2002 | Elkins et al. | |
| 6,427,576 | B1 | 8/2002 | Bock et al. | |
| 6,509,733 | B2 * | 1/2003 | Blubaugh et al. | 324/207.13 |
| 6,554,247 | B2 | 4/2003 | Berckenhoff et al. | |
| 6,877,565 | B2 | 4/2005 | Edvardsen et al. | |
| 7,023,199 | B2 * | 4/2006 | Blubaugh et al. | 324/207.13 |
| 7,051,989 | B2 | 5/2006 | Springett et al. | |
| 7,121,185 | B2 | 10/2006 | Alrefai | |
| 7,234,530 | B2 | 6/2007 | Gass | |
| 7,274,989 | B2 | 9/2007 | Hopper | |
| 7,331,562 | B2 | 2/2008 | Springett | |
| 7,437,988 | B2 | 10/2008 | Andersson et al. | |
| 7,559,533 | B2 * | 7/2009 | Stockmaster et al. | 254/270 |
| 7,762,338 | B2 | 7/2010 | Fenton et al. | |
| 7,980,305 | B2 | 7/2011 | Judge et al. | |
| 8,136,247 | B2 | 3/2012 | Foote | |
| 8,544,538 | B2 | 10/2013 | Weir | |
| 2004/0056653 | A1 | 3/2004 | Bocek et al. | |
| 2006/0213365 | A1 | 9/2006 | Dorr | |
| 2007/0102655 | A1 | 5/2007 | Springett | |
| 2008/0040070 | A1 | 2/2008 | McClanahan | |
| 2008/0196888 | A1 | 8/2008 | Judge et al. | |
| 2008/0197306 | A1 | 8/2008 | Judge | |
| 2008/0265188 | A1 | 10/2008 | Springett et al. | |
| 2009/0056132 | A1 | 3/2009 | Foote | |
| 2010/0243926 | A1 | 9/2010 | Weir | |
| 2012/0000646 | A1 | 1/2012 | Liotta et al. | |
| 2012/0001101 | A1 | 1/2012 | Dietz et al. | |
| 2012/0012340 | A1 | 1/2012 | Ensley | |
| 2013/0146793 | A1 * | 6/2013 | Gustafson | 251/1.3 |

OTHER PUBLICATIONS

International Preliminary Report on Patentability for PCT Application No. PCT/US2011/041894 dated Jan. 6, 2013, 5 pages.

International Search Report and Written Opinion for PCT Patent Application No. PCT/US2014/045818 dated Mar. 20, 2015, 10 pages.

International Preliminary Report on Patentability and Written Opinion for PCT Patent Application No. PCT/US2014/045818 dated Jan. 5, 2016, 7 pages.

* cited by examiner

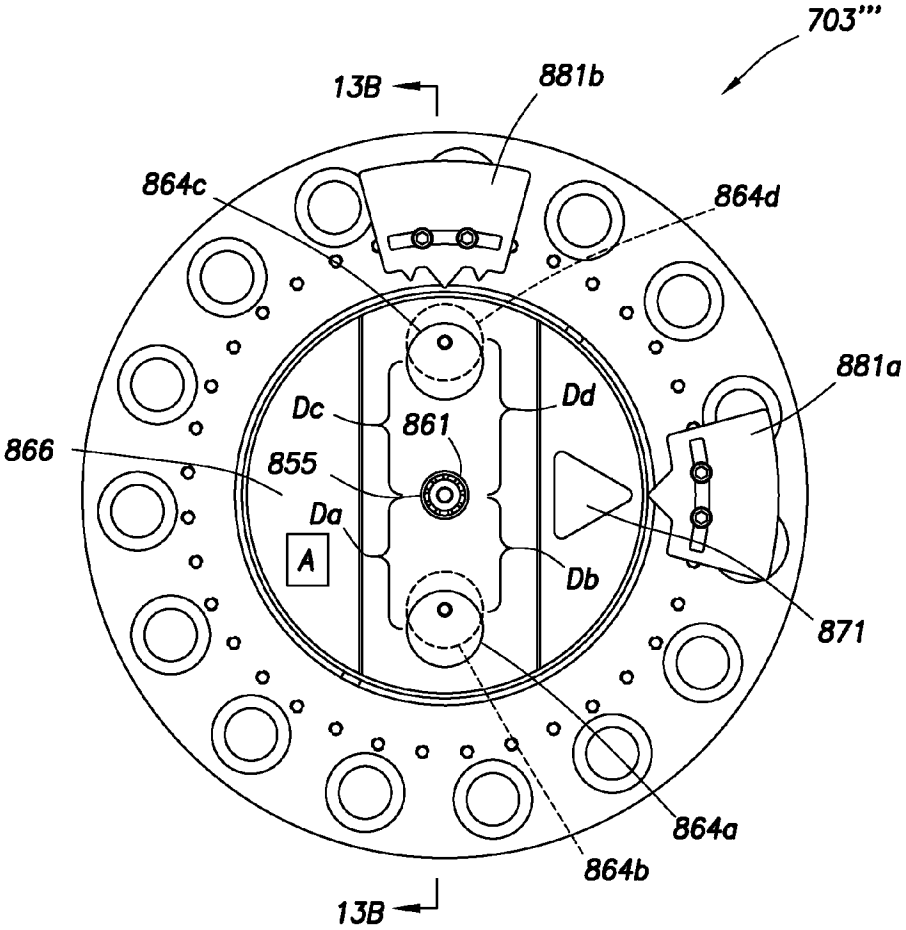
FIG. 12A2
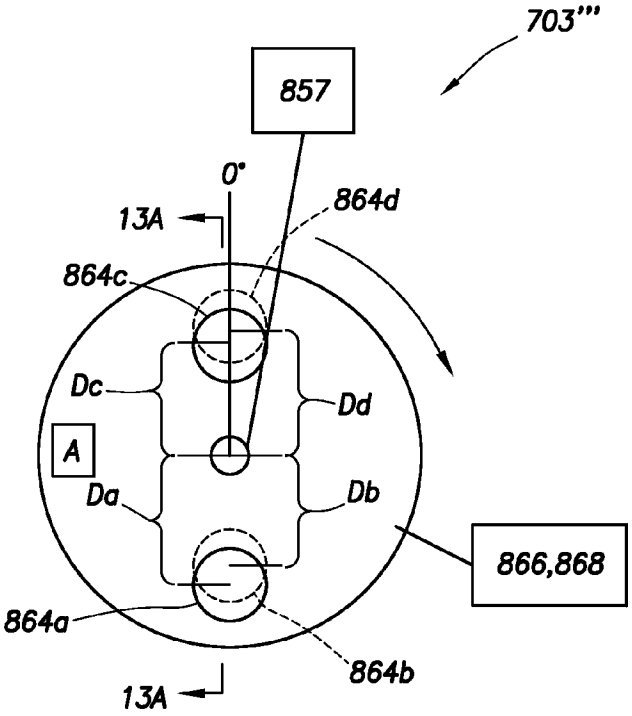
FIG. 12A1

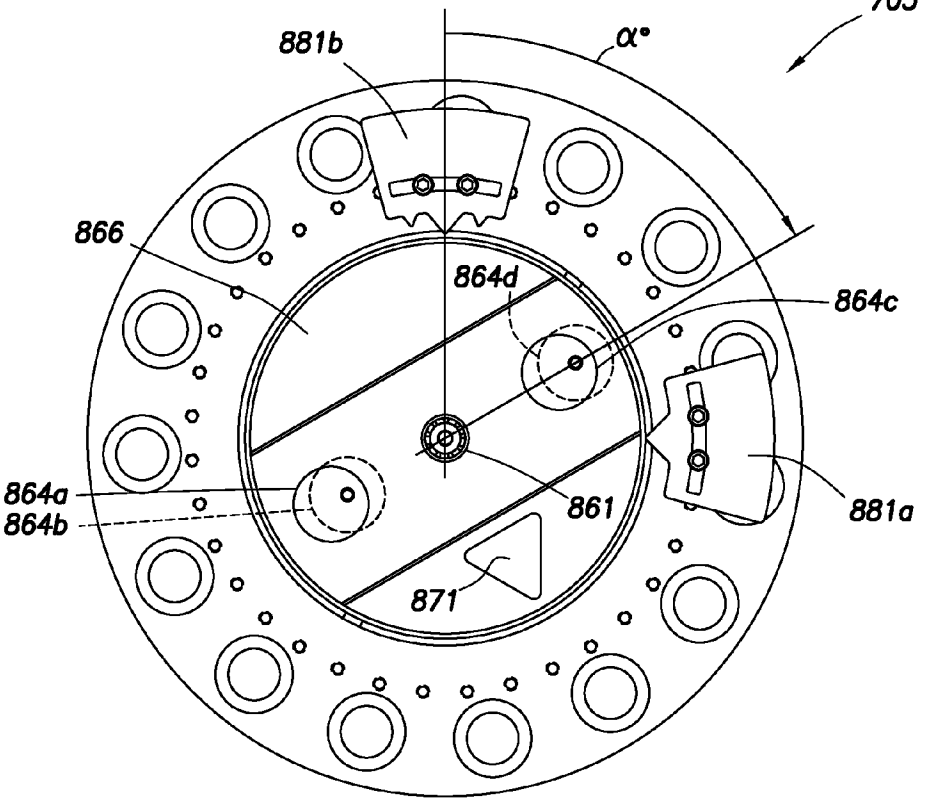
FIG. 12B2
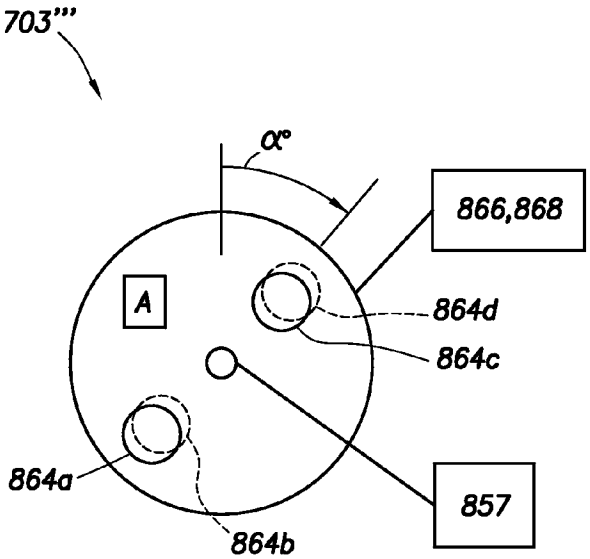
FIG. 12B1

BLOWOUT PREVENTER MONITOR WITH TRIGGER SENSOR AND METHOD OF USING SAME

CROSS-REFERENCE TO RELATED APPLICATIONS

This patent application claims priority to U.S. Provisional Application No. 61/842,232 filed on Jul. 2, 2013, the entire contents of which are hereby incorporated by reference herein. This patent application is also a continuation-in-part of U.S. Non-Provisional application Ser. No. 13/168,594 filed on Jun. 24, 2011, which claims priority to U.S. Provisional Application No. 61/360,783 on Jul. 1, 2010, the entire contents of which are hereby incorporated by reference.

BACKGROUND

The present disclosure relates generally to techniques for performing wellsite operations. More specifically, the present disclosure relates to techniques, such as blowout preventers (BOPs), packers, and/or ram blocks, for sealing wellbores.

Oilfield operations may be performed to locate and gather valuable downhole fluids. Oil rigs are positioned at wellsites and downhole tools, such as drilling tools, are deployed into the ground to reach subsurface reservoirs. Once the downhole tools form a wellbore to reach a desired reservoir, casings may be cemented into place within the wellbore, and the wellbore completed to initiate production of fluids from the reservoir. Tubing or pipes may be positioned in the wellbore to enable the passage of subsurface fluids to the surface.

Leakage of subsurface fluids may pose a significant environmental threat if released from the wellbore. Equipment, such as blow out preventers (BOPs), may be positioned about the wellbore to form a seal about pipes therein to prevent leakage of fluid as it is brought to the surface. In some cases, the BOPs employ rams and/or ram blocks that seal the wellbore. Some examples of BOPs and/or ram blocks are provided in U.S. Pat. Nos. 4,647,002, 6,173,770, 5,025,708, 7,051,989, 5,575,452, 6,374,925, 2008/0265188, 5,735,502, 5,897,094, 7,234,530, 8,544,538, 8,136,247, 2010/0243926, and 2012/0012340. The location of the ram and/or ram block of a BOP may be measured by visually looking at a tail shaft of the ram blocks. Ram position sensors may be provided as described, for example, in US Patent/Application No. 2008/0197306, U.S. Pat. Nos. 4,922,423, 5,320,325, 5,407,172, and 7,274,989.

SUMMARY

In at least one aspect, the disclosure relates to a monitor for a blowout preventer of a wellbore. The blowout preventer includes a housing, at least one ram slidably positionable in the housing to form a seal about the wellbore, and an actuator. The actuator comprises a cylinder with a piston slidably movable therein. The piston is operatively connectable with the ram and movable therewith. The monitor includes a monitor base operatively connectable to the cylinder (the monitor base having an interior side inside the cylinder and an exterior side outside the cylinder), an interior plate positionable inside the cylinder about the interior side of the base (the interior plate operatively connectable to the piston and movable therewith), an exterior plate positionable outside the cylinder about the exterior surface of the monitor base (the exterior plate coupled by magnets to the interior plate and rotatable therewith), and a trigger sensor operatively connectable about the monitor base and the exterior plate to detect rotation thereof whereby a position of the ram may be determined.

The monitor may also include a cable operatively connecting the interior plate to the piston. The interior plate may include a pulley wheel, with the cable disposable about the pulley wheel. The interior plate may include a cover with a hole to pass the cable therethrough, and/or a rotary spring. The monitor base may have an interior pocket to receive the interior plate, and may have a shaft operatively connectable to the interior plate. The trigger sensor may include a sensor base and a trigger, the sensor base may be operatively connectable to the monitor base and have a rod extending into the exterior plate, and the trigger may be positionable about the exterior plate to deflect the rod to an offset position detectable by the sensor base as the exterior plate rotates whereby a position of the ram may be determined.

The exterior plate may have a trigger pocket therein to receive the trigger, the trigger may include a spring and a plunger, with the plunger urged by the spring against the rod, the trigger sensor may include a bearing positionable in the exterior plate and having a hole therethrough to receive the rod, with the trigger engagable with the bearing to deflect the rod, and/or the sensor base may be fixedly positioned in a sensor receptacle of the monitor base with the rod deflectingly extending from the sensor base. The rod tip of the rod may extend from the sensor base into the trigger pocket, and the rod tip may be movable in the trigger pocket as the interior plate rotates.

The trigger sensor may include a sensor base operatively connectable to the monitor base and having a rod extending to the exterior plate to detect keys along a periphery thereof. The keys may include teeth, and/or black and white portions. The exterior plate may include base plate and the ring, and a dial operatively connectable to the base plate and movable therewith. The exterior plate may be rotatable via the magnets with the interior plate, and the exterior plate may have a dial thereon rotatable with the interior plate. The trigger sensor may include a strain gauge. The magnets may include interior magnets operatively connectable between the interior plate and the monitor base. The magnets may include exterior magnets operatively connectable between the exterior plate and the monitor base. The monitor base may include an end cap of the cylinder. The monitor may also include at least one seal, and/or an accelerometer.

In yet another aspect, the disclosure relates to a monitoring system for a wellbore penetrating a subterranean formation. The system includes a blowout preventer positionable about the wellbore and a monitor operatively connectable with the blowout preventer. The blowout preventer includes a housing, at least one ram slidably positionable in the housing to form a seal about the wellbore, and an actuator comprising cylinders with pistons slidably movable therein. The piston is operatively connectable with the at least one ram and movable therewith. The monitor includes a monitor base, an interior plate, an exterior plate, and a trigger sensor. The monitor base is operatively connectable to the cylinder and has an interior side inside the cylinder and an exterior side outside the cylinder. The interior plate is positioned inside the cylinder about the interior side of the base, and is operatively connectable to the piston and movable therewith. The exterior plate is positioned outside the cylinder about the exterior surface of the monitor base, and is coupled by magnets to the interior plate and is movable therewith. The trigger sensor is operatively connectable to the monitor base, and has a rod positionable about the exterior plate to detect rotation thereof whereby a position of the ram may be determined. The system may include an inspector and/or a controller operatively connectable to the trigger sensor. The inspector may be a remote operated vehicle and/or an operator.

In yet another aspect, the disclosure relates to a method of monitoring a blowout preventer of a wellbore penetrating a subterranean formation. The blowout preventer includes a housing, at least one ram slidably positionable in the housing to form a seal about the wellbore, and an actuator comprising cylinders with pistons slidably movable therein. The piston is operatively connectable with the at least one ram and movable therewith. The method involves operatively connecting a monitor including a monitor base, an interior plate, an exterior plate, and a trigger sensor to the blowout preventer by operatively connecting the monitor base to the cylinder, an interior plate about an interior surface of the monitor base, and an exterior plate about an exterior surface of the monitor base. The method further involves rotating the interior plate with the rams via a cable, rotating the exterior plate with the interior plate via the magnets, and determining a position of the rams by sensing rotation of the exterior plate with the trigger sensor.

The method may also include collecting data from the trigger sensor, passing data from the trigger sensor to a surface unit, and/or adjusting the blowout preventer based on the determining. The trigger sensor may include a sensor base positionable in the monitor base and a rod extending from the sensor base into the exterior plate and the determining may involve detecting a position of the exterior plate by deflecting the rod and measuring a position of the rod with the sensor base during the rotating. The trigger sensor may include a sensor base positionable in the monitor base and a rod extending from the sensor base into the exterior plate, and the determining may involve detecting a position of the exterior plate by detecting keys along a periphery of the exterior plate with the trigger sensor.

In another aspect, the invention relates to a blowout preventer for sealing a tubular of a wellbore. The wellbore penetrates a subterranean formation. The blowout preventer has a housing having a bore therethrough for receiving the tubular, at least one ram slidably positionable in the housing (each of the rams having a ram block for sealing engagement about the tubular), an actuator for selectively driving the ram block (the actuator having a piston slidably positionable in a cylinder), and a monitor for detecting the piston therein. The monitor includes a visual indicator on an exterior of the cylinder. The visual indicator is operatively coupled to the piston for displaying a position of the piston as the piston travels within the cylinder whereby a position of the ram may be determined.

The visual indicator may have a cable operatively connected to the piston. The cable may be operatively connectable to a dial via a pulley and rotatable thereby as the piston moves within the cylinder. The visual indicator may also have at least one gear for operatively coupling the pulley to the dial. The visual indicator may have a magnetic coupler for coupling the dial to the pulley. The visual indicator may have a housing integral with the cylinder. The visual indicator may also have a plurality of flags positioned on a flag rod. The plurality of flags may be selectively raisable as the piston passes adjacent thereto. The visual indicator may have a magnet slidably positionable on a guide in response to a magnet on the piston passing adjacent thereto. The visual indicator may have a transparent case with a plurality of metal filings movably positionable therein in response to a magnet on the piston passing adjacent thereto. The visual indicator may have a transparent case with a magnetic indicator movably positionable therein in response to a magnet on the piston passing adjacent thereto. The blowout preventer may also have a visual sensor for detecting the visual indicator.

The blowout preventer may also have an electrical indicator for detecting a position of the piston. The electrical indicator may have a magnet slidably positionable on a guide in response to a magnet on the piston passing adjacent thereto, and at least one Hall Effect sensor for detecting a position of the magnet on the guide. The electrical indicator may be an inductive resistance sensor comprising a coil disposed about the cylinder. The electrical indicator may have a top end ultrasonic sensor at a top end of the cylinder and a bottom end ultrasonic sensor at a bottom end of the cylinder for detecting the piston when adjacent thereto. The electrical indicator may have an ultrasonic limit sensor. The electrical indicator may be a laser sensor. The electrical indicator may have a capacitive displacement sensor. The electrical indicator may be a sonar sensor for emitting sonar waves and sensing the waves rebounded by the piston. The electrical indicator may have at least one proximity sensor. The electrical indicator may have a flow sensor for detecting the flow of fluid through a chamber of the cylinder as the piston passes therein.

In yet another aspect, the invention relates to a system for sealing a tubular of a wellbore. The system has a blowout preventer and an inspector for inspecting visual indicator. The blowout preventer has a housing having a bore therethrough for receiving the tubular, at least one ram slidably positionable in the housing (each of the rams having a ram block for sealing engagement about the tubular), an actuator for selectively driving the ram block (the actuator having a piston slidably positionable in a cylinder), and a monitor for detecting the piston therein. The monitor includes a visual indicator on an exterior of the cylinder. The visual indicator is operatively coupled to the piston for displaying a position of the piston as the piston travels within the cylinder whereby a position of the ram may be determined.

The blowout preventer has a housing having a bore therethrough for receiving the tubular, at least one ram slidably positionable in the housing (each of the rams having a ram block for sealing engagement about the tubular), an actuator for selectively driving the ram block (the actuator having a piston slidably positionable in a cylinder), and a monitor for detecting the piston therein. The monitor includes a visual indicator on an exterior of the cylinder. The visual indicator is operatively coupled to the piston for displaying a position of the piston as the piston travels within the cylinder whereby a position of the ram may be determined.

The inspector may be a human or a remote operated vehicle (ROV). The system may also have a surface unit for receiving data from the monitor, an electrical indicator for detecting a position of the piston, a receiver for communicating signals with the electrical indicator, and/or at least one sensor for detecting wellsite parameters.

In yet another aspect, the invention relates to a method of monitoring a blowout preventer. The method involves positioning the blowout preventer about a tubular, activating at least one of the visual indicators of the monitor as the piston passes adjacent thereto, and inspecting the visual indicators. The blowout preventer has a housing having a bore therethrough for receiving the tubular, at least one ram slidably positionable in the housing (each of the rams having a ram block for sealing engagement about the tubular), an actuator for selectively driving the ram block (the actuator having a piston slidably positionable in a cylinder), and a monitor for detecting the piston therein. The monitor includes a visual indicator on an exterior of the cylinder. The visual indicator is operatively coupled to the piston for displaying a position of the piston as the piston travels within the cylinder whereby a position of the ram may be determined. The method may also involve sensing a position of the piston with an electrical indicator, manually viewing the visual indicators, sensing the visual indicator for activation, and/or passing data from the monitor to a surface unit.

Finally, in yet another aspect, the invention relates to a blowout preventer for sealing a tubular of a wellbore. The blowout preventer includes a housing having a bore therethrough for receiving the tubular, at least one ram slidably positionable in the housing (each of the at least one rams having a ram block for sealing engagement about the tubular), an actuator for selectively driving the ram block (the actuator comprising a piston slidably positionable in a cylinder), and a monitor for detecting the piston. The monitor has a housing with a cable therein. The cable is operatively connectable to the piston and movable therewith for activating a visual indicator on an exterior of the housing whereby a position of the ram may be displayed.

The monitor also may also have a sensor operatively connected for detecting movement of the cable and/or a communication link for passing data from the sensor to a surface unit. The visual indicator may have a dial rotationally movable by the cable. The monitor may also have a magnetic coupler inside of the housing for coupling the cable to the dial. The monitor also has at least one gear for operatively coupling the cable to the dial. The monitor may also have at least one pulley. The housing may be integral with the cylinder.

BRIEF DESCRIPTION OF THE DRAWINGS

The drawings illustrate example embodiments of this disclosure and are, therefore, not to be considered limiting of its scope, for the disclosure may admit to other equally effective embodiments. The figures are not necessarily to scale, and certain features and certain views of the figures may be shown exaggerated in scale or in schematic in the interest of clarity and conciseness.

FIGS. 12A1 and 12A2 are schematic views of a BOP monitor in an initial position. FIGS. 12B1 and 12B2 are schematic views of the BOP monitor in a rotated position.

DETAILED DESCRIPTION

The description that follows includes exemplary apparatus, methods, techniques, and/or instruction sequences that embody techniques of the present subject matter. However, it is understood that the described embodiments may be practiced without these specific details.

The invention is directed at techniques for providing monitoring and/or measuring of the operation of the blowout preventer (BOP). The BOP may be provided with a monitor to detect, for example, a position (or location) of a ram of the BOP. These techniques may be used to provide monitoring, such as visual or electrical monitoring, of the BOP (e.g., from the surface), such as while the BOP is in use on the seabed. Such monitoring techniques involve one or more of the following, among others: determination of BOP function, determination of ram position, determination of sealed position, constant monitoring of the ram position within the BOP, adaptability to wellsite equipment (e.g., various pipes diameters).

Blowout preventers (BOPS) may include a housing positioned about a wellbore to receive a tubing therethrough and to provide a seal thereabout, for example, during a blowout. The BOP also has rams movably positionable in the housing to engage the tubular and/or form a seal about the wellbore. A BOP monitor may be provided about the BOP to detect movement of the rams and determine a position thereof. The BOP monitor may include a monitor base disposable in the cylinder, an interior plate coupled by a cable to the ram, an exterior plate magnetically coupled to the interior plate, and sensors (e.g., strain gauges) to detect the rotation of the plates and, therefore, displacement and position of the rams.

Blowout Preventer

Figure 1:
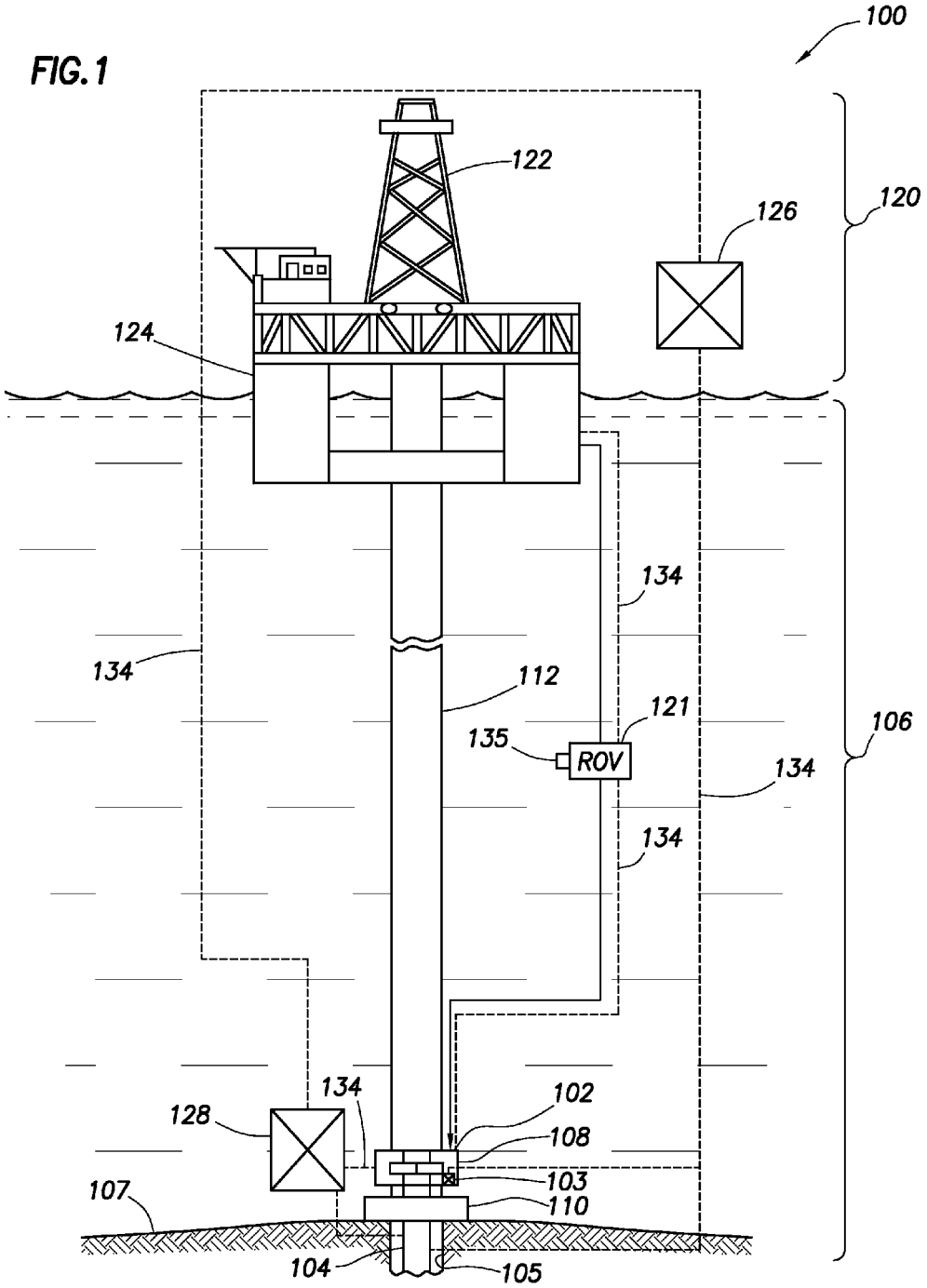
FIG. 1 shows a schematic view of an offshore wellsite having a blowout preventer (BOP) for sealing a tubular.

FIG. 1 depicts an offshore wellsite 100 having a seal assembly 102 configured to seal a wellbore 105 extending into in a seabed 107. As shown, the seal assembly 102 is positioned in a blowout preventer (BOP) 108 that is part of a subsea system 106 positioned on the seabed 107. The subsea system 106 may also comprise a pipe (or tubular) 104 extending from the wellbore 105, a wellhead 110 about the wellbore 105, a conduit 112 extending from the wellbore 105 and other subsea devices, such as a stripper and a conveyance delivery system (not shown). The BOP 108 may have a BOP monitoring system (or BOP monitor) 103 for monitoring the operation of the BOP 108. While the wellsite 100 is depicted as a subsea operation, it will be appreciated that the wellsite 100 may be land or water based, and the seal assembly 102 may be used in any wellsite environment.

A surface system 120 may be used to facilitate operations at the offshore wellsite 100. The surface system 120 may include a rig 122, a platform 124 (or vessel) and a surface controller 126. Further, there may be one or more subsea controllers 128. While the surface controller 126 is shown as part of the surface system 120 at a surface location and the subsea controller 128 is shown as part of the subsea system 106 in a subsea location, it will be appreciated that one or more controllers may be located at various locations to control the surface and/or subsea systems.

To operate one or more seal assemblies 102 and monitor the BOP monitoring system 103 and/or other devices associated with the wellsite 100, the surface controller 126 and/or the subsea controller 128 may be placed in communication therewith. The surface controller 126, the subsea controller 128, and/or any devices at the wellsite 100 may communicate via one or more communication links 134. The communication links 134 may be any suitable communication means, such as hydraulic lines, pneumatic lines, wiring, fiber optics, telemetry, acoustics, wireless communication, any combination thereof, and the like. The seal assembly 102, the BOP monitoring system 103, the BOP 108, and/or other devices at the wellsite 100 may be automatically, manually and/or selectively operated via the surface and subsea controllers 126 and/or 128, respectively.

A remote operated vehicle (ROV) 121 may optionally be provided to travel below the surface and inspect the BOP monitoring system 103. The ROV 121 may be provided with a camera 135 to display images of the BOP monitoring system 103 and/or electrical communicators (e.g., communication link 134) for coupling to the BOP monitoring system 103. The ROV 121 may be in communication with the surface unit 126 and/or BOP 108 via a communication link 136. In some cases, a diver or other inspector may be used to visually inspect the BOP monitoring system 103.

Figure 2:
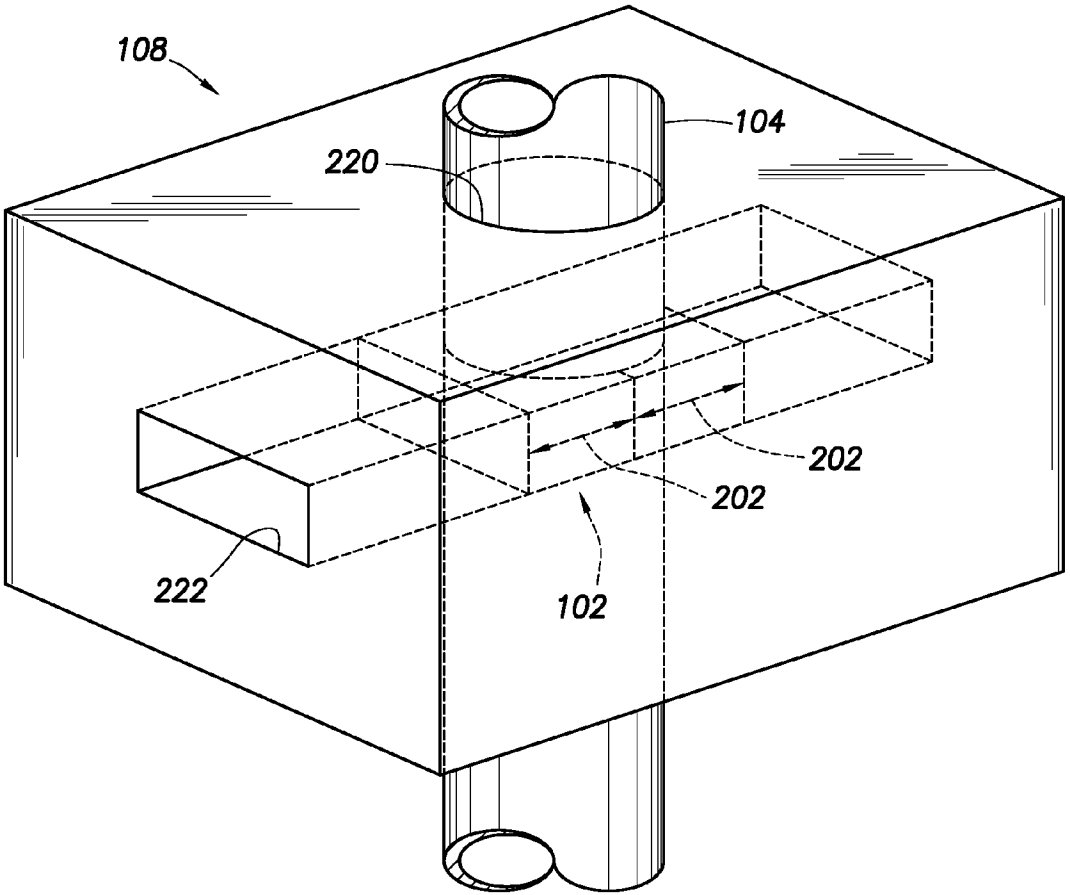
FIG. 2 shows a schematic perspective view of the BOP of FIG. 1.

FIG. 2 shows a schematic view of a BOP 108 that may be used as the BOP 108 of FIG. 1. The BOP 108 is schematically depicted as a cuboid-shaped device having a bore (or channel) 220 therethrough for receiving the pipe 104. The BOP 108 is also provided with a channel 222 therethrough for receiving the seal assembly 102. While the BOP 108 is depicted as having a specific configuration, it will be appreciated that the BOP 108 may have a variety of shapes, and be provided with other devices, such as sensors (not shown). An example of a BOP that may be used is described in U.S. Pat. No. 5,735,502, the entire contents of which is hereby incorporated by reference.

The seal assembly 102 comprises one or more rams 202 for sealing the BOP 108. The rams 202 may be any suitable device for sealing the interior of the BOP 108 and/or severing the pipe 104, for example rams, ram blocks, and/or shearing blades. Upon actuation of the rams 202 of the seal assembly 102, the rams 202 may move along the channel 222 toward the pipe 104. The seal assembly 102 may seal the pipe 104 within the BOP 108, thereby preventing fluids, such as wellbore fluids and/or sea water, from passing through the BOP 108. Further, the seal assembly 102 may severe the pipe 104 if the seal assembly 102 has shearing blades.

Figure 3:
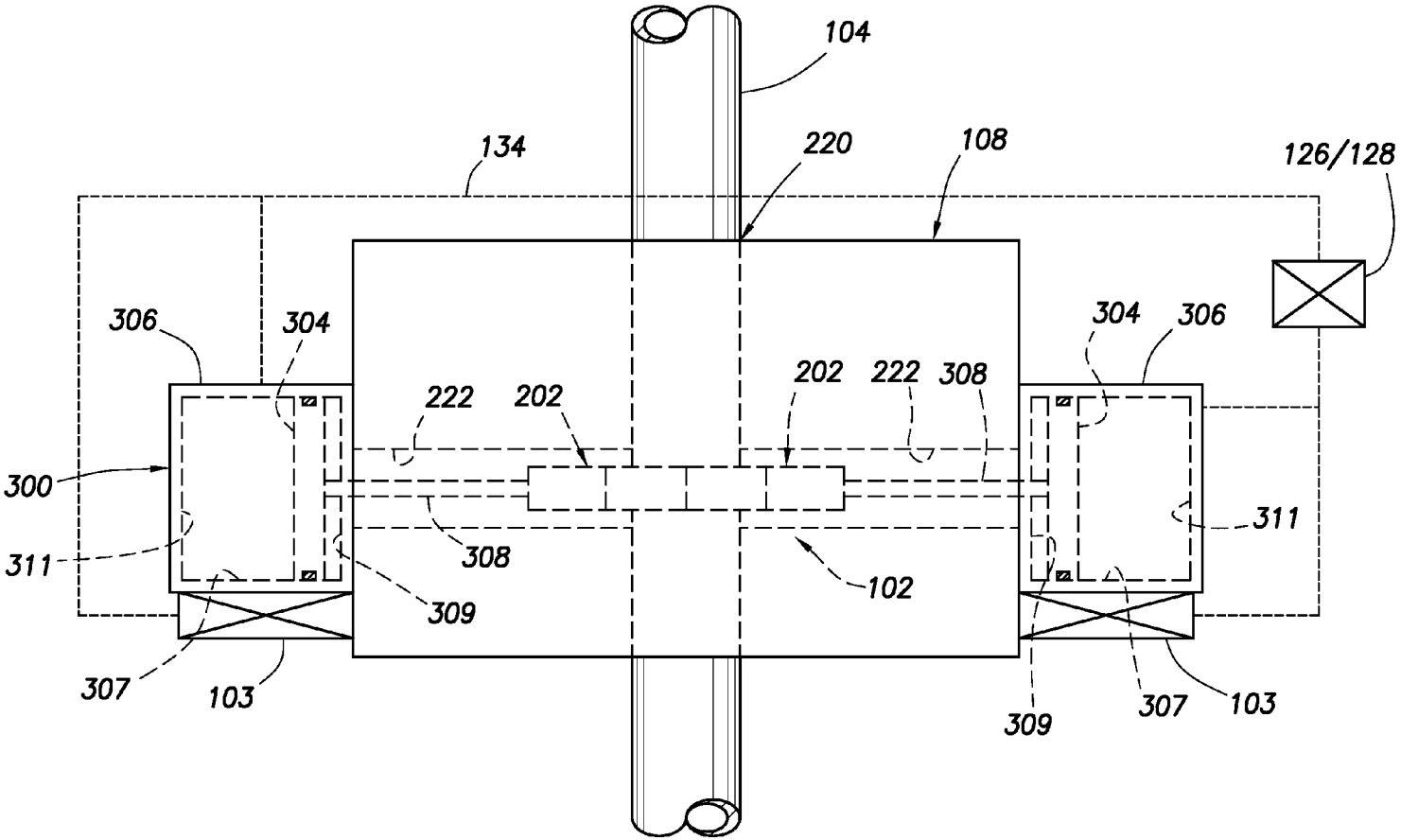
FIG. 3 shows a schematic side view of the BOP of FIG. 2 having one or more actuator(s) and a BOP monitoring system.

FIG. 3 shows a schematic side view of the BOP 108 of FIG. 2 having an actuator 300 coupled to each of the rams 202. The actuator 300 may be configured to move the rams 202 between an un-actuated position wherein the rams 202 are not engaged with the pipe 104 and an actuated position (as shown in FIG. 3) wherein the rams 202 are engaged with the pipe 104. In the un-actuated position, the pipe 104 may move through the BOP 108 and into and/or out of the wellbore 105 (see, e.g., FIG. 1). In the actuated position, the pipe 104 and/or the central bore 220 of the BOP 108 may be sealed about pipe 104 by the rams 202.

The actuator 300 as shown, is a hydraulic actuator configured to move a piston 304 within a cylinder 306 using hydraulic fluid supplied to the actuator 300. The cylinder 306 has a side 307, a head 309 and a rear 311. The piston 304 is slidably movable within the cylinder 306 by, for example, hydraulic pressure selectively applied thereto. The piston 304 may couple to a rod 308 (or ram shaft) that is configured to move the rams 202 as piston 304 moves. Although the actuator 300 is shown as a hydraulic piston and cylinder, the actuator 300 may be any suitable actuator for moving the rams 202 between the actuated and the un-actuated positions.

As the piston 304 moves within the cylinder 306, the BOP monitoring system 103 may monitor the location of the piston 304. With the location of the piston 304 determined, the location of the rams 202 within the BOP 108 may be determined. The data collected by the BOP monitoring system 103 may be sent via the communication links 134 to the surface and subsea controller(s) 126/128 in order to, for example, determine how the BOP 108 is operating. The BOP monitoring system 103 may be any suitable system for determining the location of the pistons 304, the rods 308 and/or the rams 202 within the BOP 108. The monitoring system 103 may also be capable of determining other downhole parameters of the BOP 108, its components and/or associated downhole conditions.

Blowout Preventer Monitoring Systems

Figure 4A:
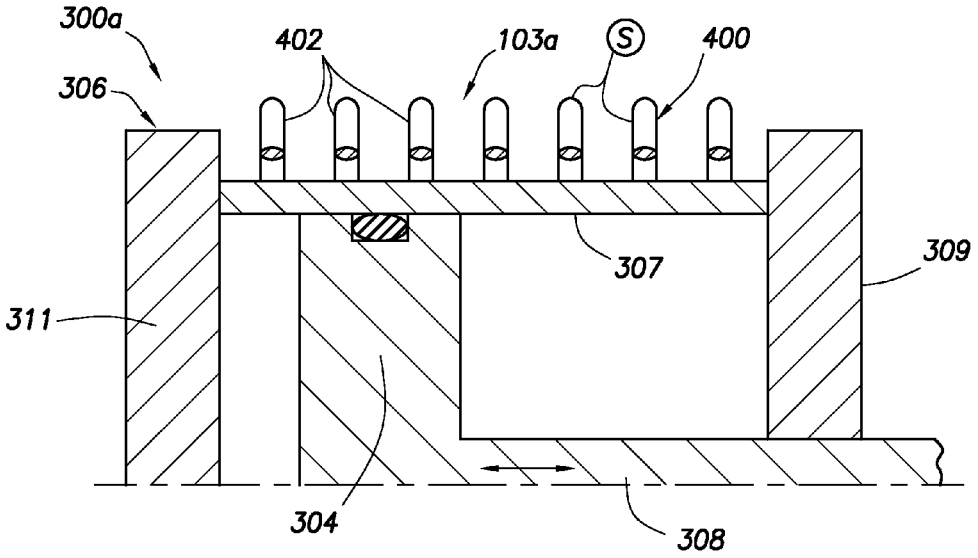
FIGS. 4A-4N show schematic cross-sectional views of various versions of a portion of an actuator and a monitoring system operatively connected thereto.
Figure 4B:
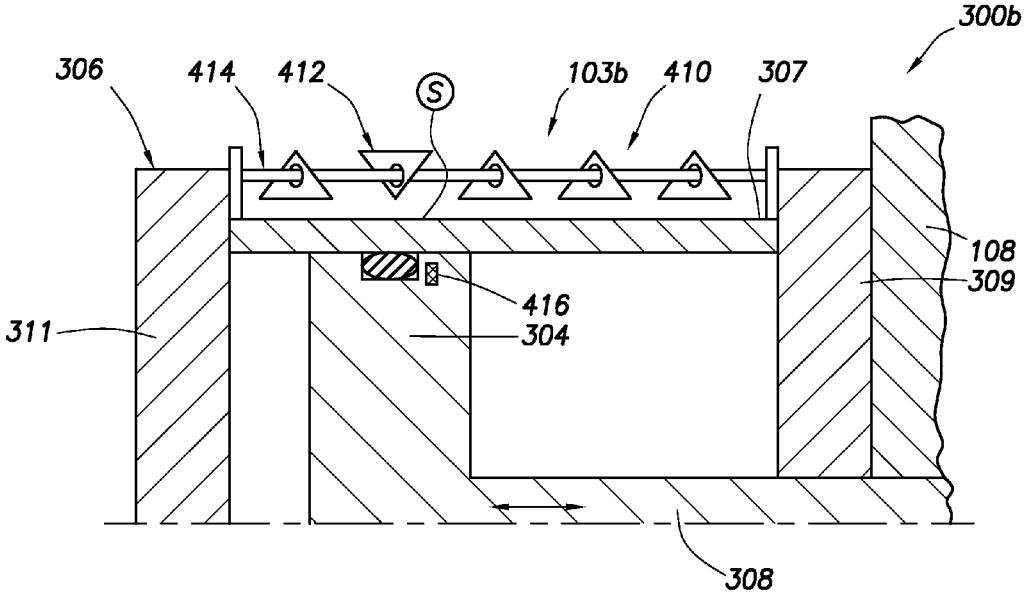
Figure 4C:
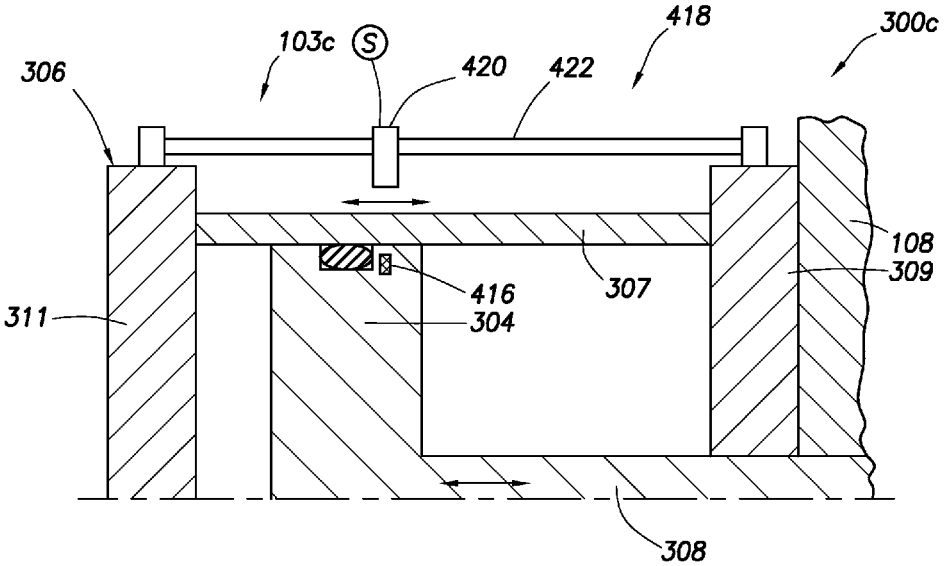
Figure 4D:
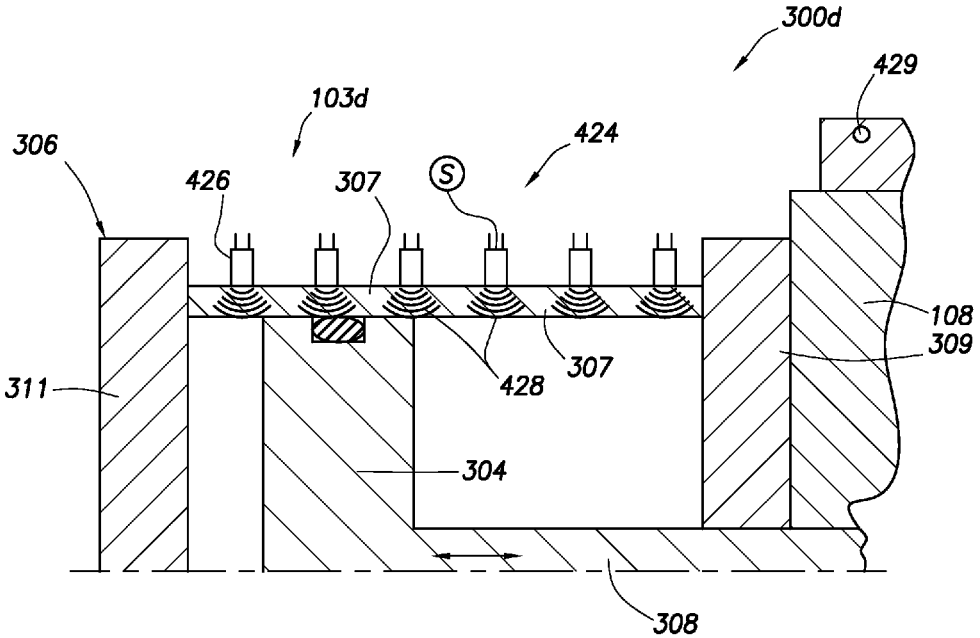
Figure 4E:
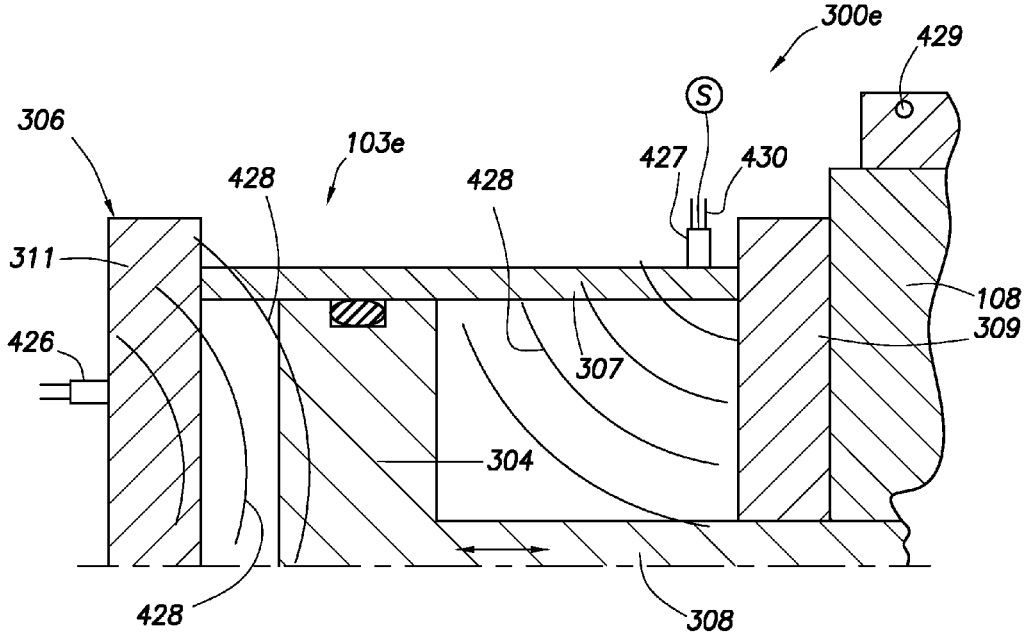
Figure 4F:
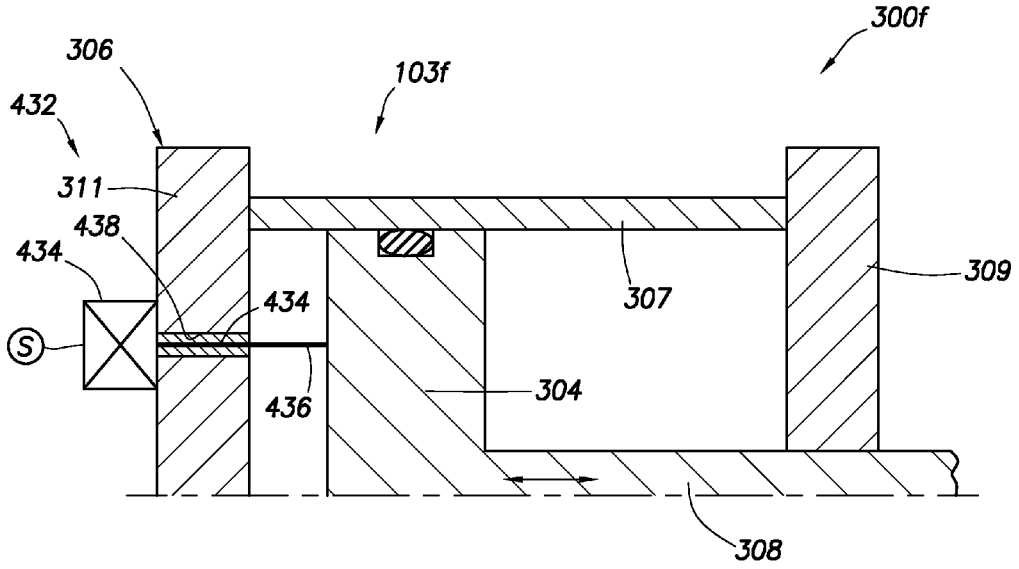
Figure 4G:
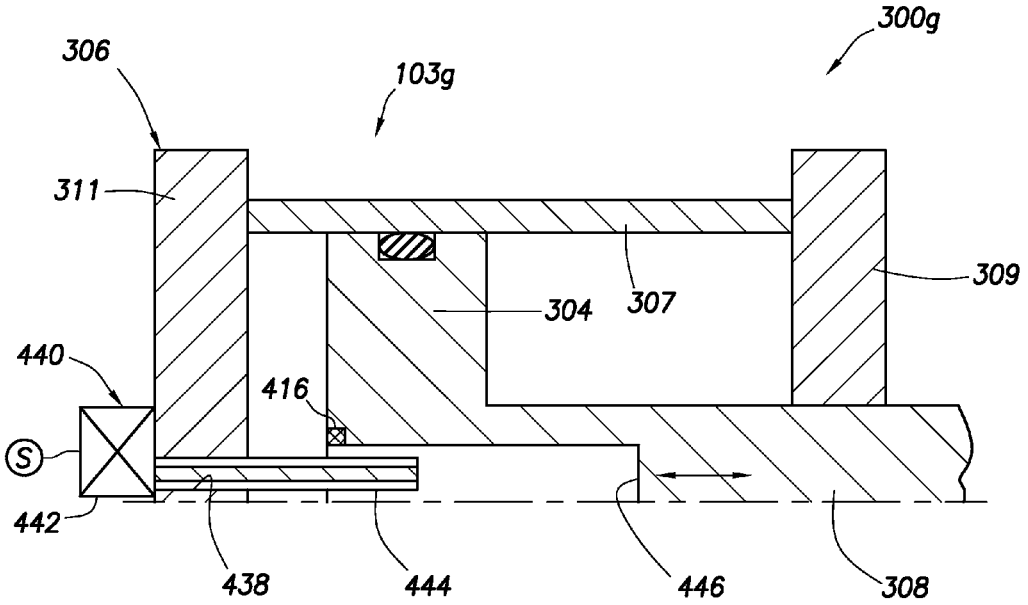
Figure 4H:
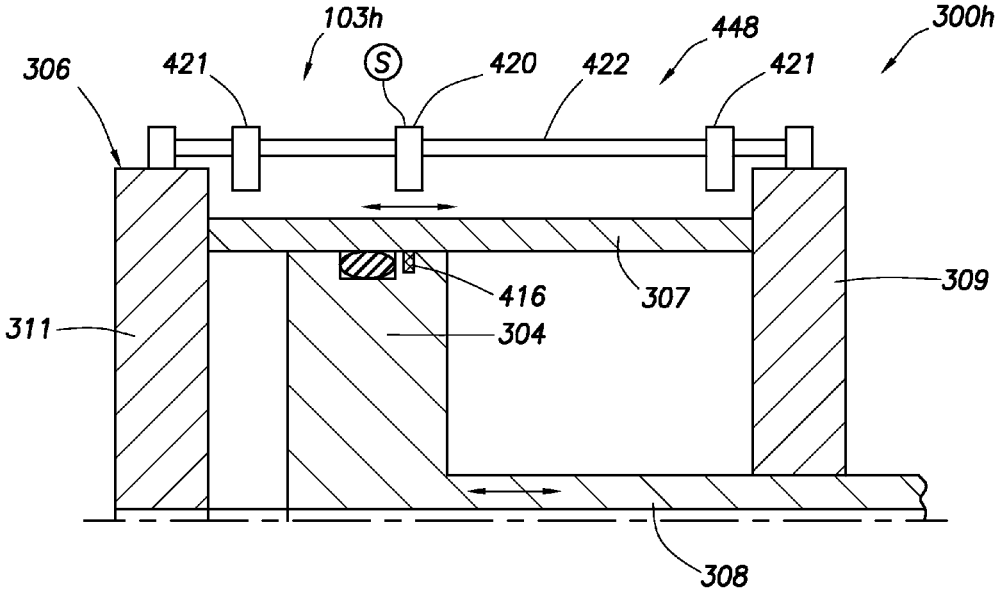
Figure 4I:
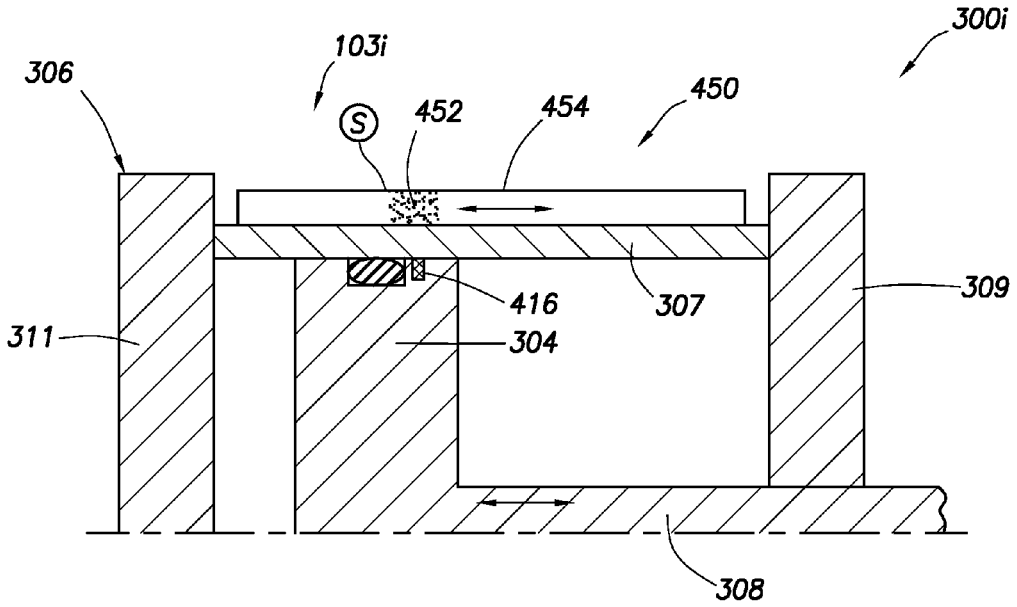
Figure 4J:
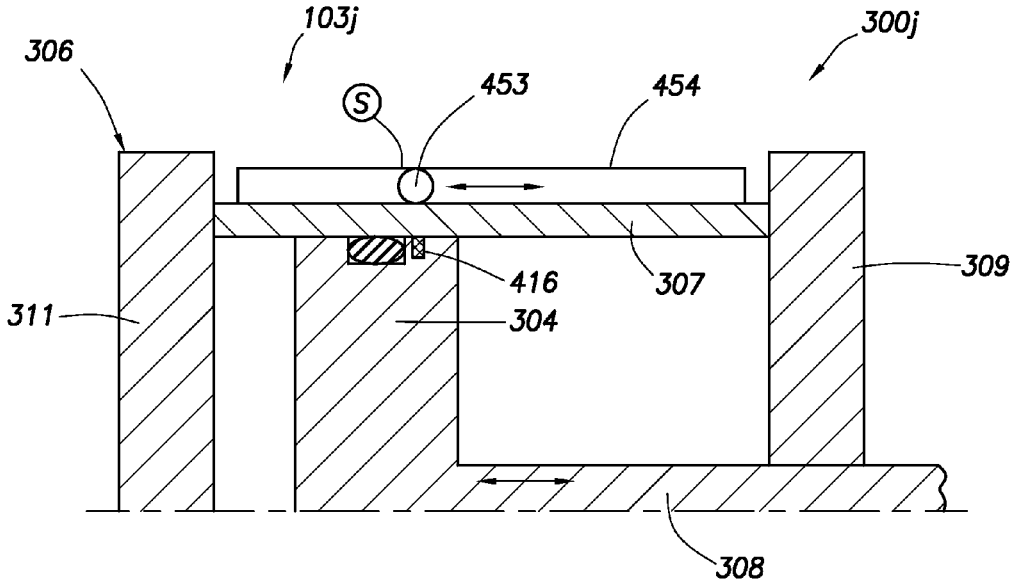
Figure 4K:
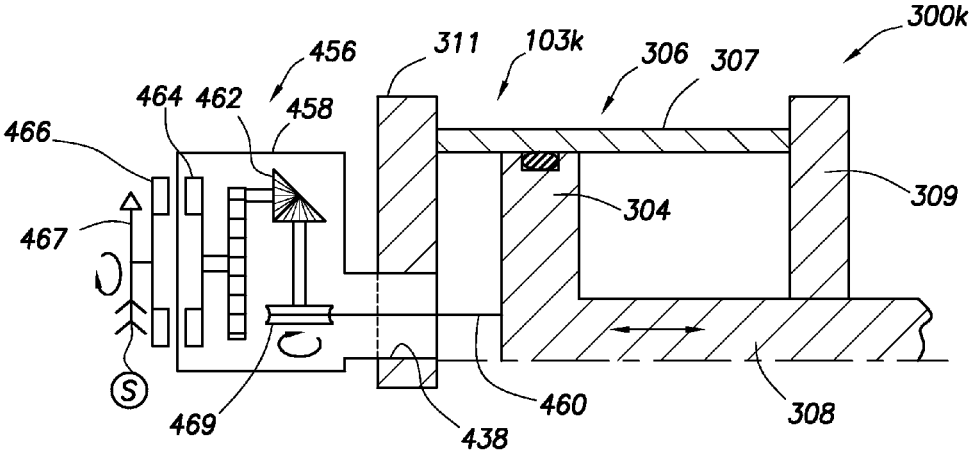
Figure 4L:
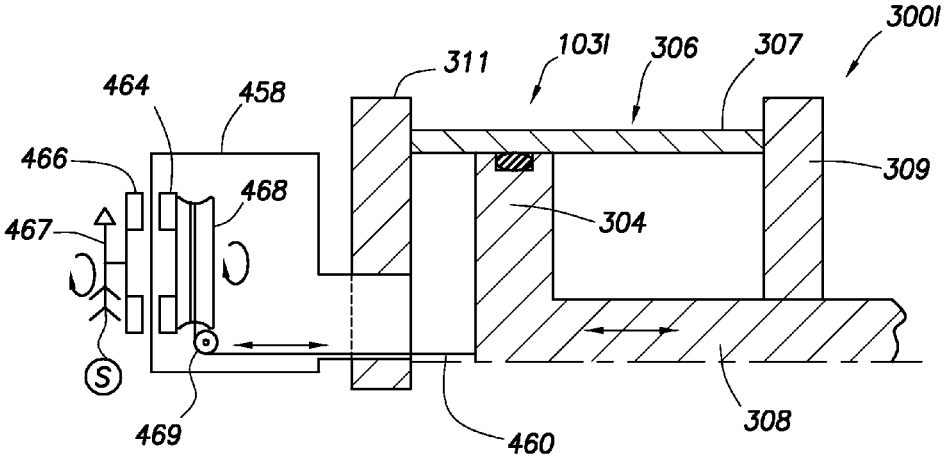
Figure 4M:
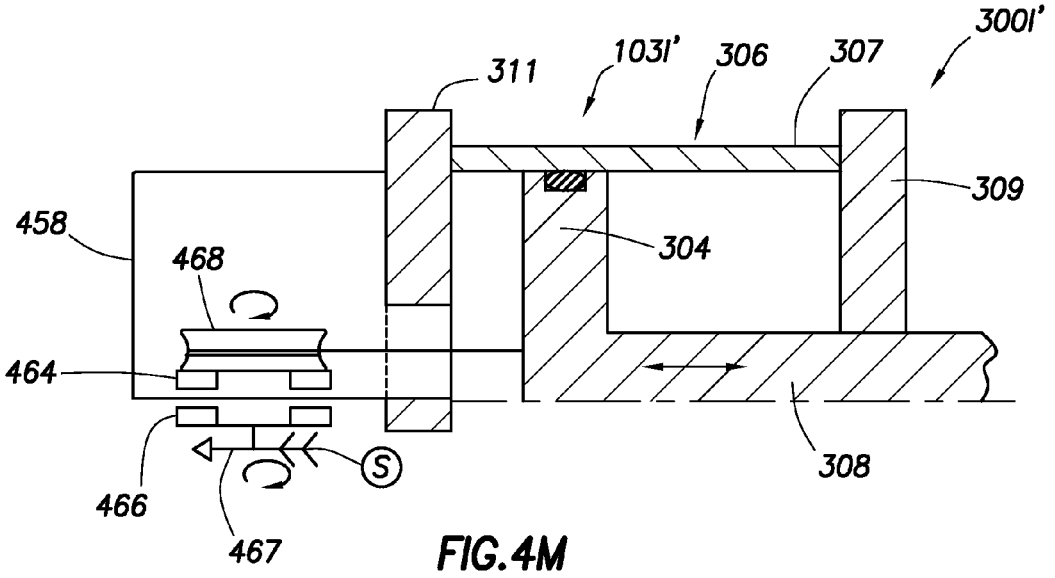
Figure 4N:
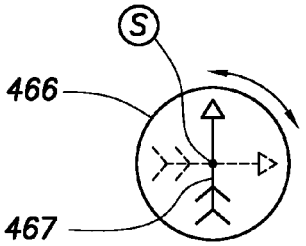

FIGS. 4A-4N depict cross-sectional views of a portion of the actuator 300*a-m* having various versions of a monitoring system 103*a-m* usable as the actuator 300 and BOP monitoring system 103 of FIG. 3. As shown in each of these figures, the piston 304 is slidably movable within the cylinder 306. The monitoring systems 103*a-m* are each positionable about the cylinder 306 and have devices for detecting a position of the piston 304 therein. Each piston 304 is operatively connectable to a ram 202 (see FIGS. 2 and 3) and, therefore, a position of the rams 202 (and/or components thereof) may also be determined. A visual indicator sensor S may optionally be positioned about the monitoring systems for detecting activation, position, or other parameters of the wellsite and/or components, such as the monitoring system 103*a-m*.

FIG. 4A depicts an actuator 300*a* with a BOP monitoring system 103*a* as an inductive resistance sensor 400. The inductive resistance sensor 400 may have one or more coils 402 that wrap around the outside of the side 307 of the cylinder 306. A current may be supplied to the coils 402 and a resistance in the coils 402 may be measured during the operation of the actuator(s) 300*a*.

The piston 304 travels within the cylinder 306 between the cylinder head 309 and the cylinder rear 311 of the BOP 108. The resistance in the coils 402 changes as a function of the location of the piston 304. The coils 402 may individually change as the piston 304 passes thereby, thus indicating that the piston 304 is adjacent to a certain coil 402. The changes in resistance may be used to determine the location of the piston 304 and the rod 308. Thus, the location of the rams 202 (as shown in FIG. 3) may also be determined. The inductance of the coils may be measured and received by the ROV 121 and/or the surface unit 126 (FIG. 1) to provide an electrical indication of the location of the piston 304 and the ram 202. Sensor S may be provided to pass signals from the coils 402 to a receiver positioned about the wellsite 100. A visual indicator, such as those provided herein, may also optionally be coupled to the monitoring system 103*a* to provide a visual indication of position upon activation by the monitoring system 103*a*.

FIG. 4B depicts an actuator 300*b* with a BOP monitoring system 103*b* as a magnetic flag sensor 410. The magnetic flag sensor 410 may have one or more magnetic flags 412 located on the outside of a side 307 of the cylinder 306. Each of the magnetic flags 412 may be secured to the cylinder 306 on an axis 414 that allows the magnetic flag 412 to rotate thereabout in response to a piston magnet 416 passing thereby. Each magnetic flag 412 may be magnetic, or have a magnet thereon. Each magnetic flag 412 may be at a downward position gravitationally, and raise as the piston magnet 416 passes thereby.

The piston magnet 416 may be any magnet secured to, or proximate the piston 304. As the piston 304 travels within the cylinder 306 between the cylinder rear 311 and the cylinder head 309, the piston magnet 416 raises the magnet flags 412 proximate the piston 304. The raised magnet flags 412 may be used to provide a visual indication of the location of the piston 304 and the rod 308. Thus, the location of the rams 202 (as shown in FIG. 3) may also be indicated. The sensor S may also be operatively coupled to one or more flags to provide an electrical and/or visual indication of the activation of a given flag. The sensor S may pass the signal to various components for communicating a position of the piston 304.

FIG. 4C depicts an actuator 300*c* with a BOP monitoring system 103*c* as a sliding magnetic sensor 418. The sliding magnetic sensor 418 may have one or more sliding magnets 420 secured to a guide rod 422 located on the outside of the side 307 of the cylinder 306. Each of the sliding magnets 420 may be secured to the guide rod 422 in a manner that allows the sliding magnet 420 to translate along the guide rod 422 in response to the movement of the piston magnet 416.

As the piston 304 travels within the cylinder 306 between the cylinder rear 311 and the cylinder head 309, the piston 304 with a magnet 416 thereon translates the sliding magnet 420 proximate the piston 304. The location of the sliding magnet 420 may provide a visual indicator of the piston 304. Limit switches or other devices, such as sensor S, may also be used to detect and/or communicate the position of the sliding magnet 420 along the guide rod 422. The sliding magnet 420 location may be used to determine the location of the piston 304 and the rod 308. Thus, the location of the rams 202 (as shown in FIG. 3) may also be determined.

FIG. 4D depicts an actuator 300*d* and a BOP monitoring system 103*d* as an ultrasonic sensor 424. The ultrasonic sensor 424 may have one or more ultrasonic inducers 426 located around the outside of side 307 of the cylinder 306. Each of the ultrasonic inducers 426 produce ultrasonic waves 428 that are directed into an interior of the cylinder 306 and then detected by a receiver 429. As shown, the receiver 429 is positioned in the BOP 108.

Changes in the ultrasonic waves 428 may indicate the location of the piston 304 proximate to one or more of the ultra sonic inducers 426. As the piston 304 travels within the cylinder 306 between the cylinder rear 311 and the cylinder head 309, the detected changes in the ultrasonic waves 428 may be used to determine the location of the piston 304 and the rod 308. Thus, the location of the rams 202 (as shown in FIG. 3) may also be determined. The ultrasonic waves detected by the receiver 429 may be passed to the ROV 121 and/or the surface unit 126 (FIG. 1) to provide an indication of the location of the piston 304 and the ram 202. The sensor S may also be operatively coupled to one or more ultrasonic inducers 426 to provide an electrical and/or visual indication of the activation of a given ultrasonic inducer. The sensor S may pass the signal to various components, such as receiver 429, for communicating a position of the piston 304. A visual indicator, such as those provided herein, may also optionally be coupled to the monitoring system 103*d* to provide a visual indication of position upon activation by the monitoring system 103*d*.

FIG. 4E depicts an actuator 300*e* and a BOP monitoring system 103*e* as an ultrasonic limit sensor 430. The ultrasonic limit sensor 430 may have two ultra sonic inducers 426, 427 each located proximate a travel limit of the piston 304 within cylinder 306. For example, one of the ultrasonic inducers 426 may be located proximate the cylinder rear 311 and the second ultrasonic inducer 427 may be located adjacent the side 307 of the cylinder 306. The second ultrasonic inducer 427 on the side 307 may be located proximate the travel limit adjacent cylinder head 309 of the piston 304.

Each of the ultrasonic inducers 426, 427 produce the ultrasonic waves 428 that are directed into an interior of the cylinder 306 and then detected by a receiver 429. Changes in the ultrasonic waves 428 may indicate the location of the piston 304 proximate to the ultra sonic inducer 426, 427. As the piston 304 travels within the cylinder 306 between the cylinder rear 311 and the cylinder head 309, the detected changes in the ultrasonic waves 428 indicate when the piston 304 reaches the travel limits in either the un-actuated position or the actuated position. Therefore, the detected changes in the ultrasonic waves 428 may be used to determine a position of the piston 304 and the rod 308. Thus, the location of the rams 202 (as shown in FIG. 3) may also be determined. The ultrasonic waves detected by the receiver 429 may be passed to the ROV 121 and/or the surface unit 126 (FIG. 1) to provide an indication of the location of the piston 304 and the ram 202. The sensor S may also be operatively coupled to one or more ultrasonic inducers 426, 427 to provide an electrical and/or visual indication of the activation of a given ultrasonic inducer. The sensor S may pass the signal to various components, such as receiver 429, for communicating a position of the piston 304. A visual indicator, such as those provided herein, may also optionally be coupled to the monitoring system 103*e* to provide a visual indication of position upon activation by the monitoring system 103*e*.

FIG. 4F depicts an actuator 300*f* and a BOP monitoring system 103*f* as a laser sensor 432. The laser sensor 432 may have one or more laser inducers 434 located proximate the end of the actuator 300*f*. As shown, the laser inducers 434 are located proximate the cylinder rear 311. The laser inducer 434 may direct a laser 436 through an aperture 438 of the cylinder 306.

The laser 436 may engage a portion of the piston 304. The laser 436 may have conventional range finding capabilities that may be used to determine the distance between the cylinder rear 311 and the piston 304 as the piston travels within the cylinder 306. The piston 304 location as determined by the laser sensor 432 may be used to determine the location of the piston 304 and the rod 308. Thus, the location of the rams 202 (as shown in FIG. 3) may also be determined. The location detected by the laser sensor 432 may be passed to the ROV 121 and/or the surface unit 126 (FIG. 1) to provide an indication of the location of the piston 304 and the ram 202. The sensor S may also be operatively coupled to the monitoring system 103*f* to provide an electrical and/or visual indication of the position detected by the laser 436. The sensor S may pass the signal to various components for communicating a position of the piston 304. A visual indicator, such as those provided herein, may also optionally be coupled to the monitoring system 103*f* to provide a visual indication of position upon activation by the monitoring system 103*f*.

FIG. 4G depicts an actuator 300*g* and a BOP monitoring system 103*g* as a linear magnetic sensor 440. The linear magnetic sensor 440 may have a sensor magnet 442 coupled to the cylinder rear 311. The sensor magnet 442 may couple to a linear sensor 444 that is placed into the cylinder 306 through an aperture 438 in the cylinder rear 311. The linear sensor 444 may detect movement of a piston magnet 416 as the piston 304 moves. As shown, the piston 304 may have a cavity 446 for allowing the piston 304 to pass the linear sensor 444 without engaging the linear sensor 444.

As the piston 304 travels within the cylinder 306 between the cylinder rear 311 and the cylinder head 309, the linear sensor 444 detects the location of the piston magnet 416. The piston magnet 416 location may be used to determine the location of the piston 304 and the rod 308. Thus, the location of the rams 202 (as shown in FIG. 3) may also be determined. The location detected by the linear sensor 444 may be passed to the ROV 121 and/or the surface unit 126 (FIG. 1) to provide an indication of the location of the piston 304 and the ram 202. The sensor S may also be operatively coupled to the monitoring system 103*g* to provide an electrical and/or visual indication of the position detected by the linear sensor 444. The sensor S may pass the signal to various components for communicating a position of the piston 304. A visual indicator, such as those provided herein, may also optionally be coupled to the monitoring system 103*g* to provide a visual indication of position upon activation by the monitoring system 103*g*.

FIG. 4H depicts an actuator 300*h* and a BOP monitoring system 103*h* as a Hall Effect sensor 448. The Hall Effect sensor 448 may have one or more sliding magnets 420 secured to the guide rod 422 located on the outside of the side 307 of the cylinder 306. Each of the sliding magnets 420 may be secured to the guide rod 422 in a manner that allows the sliding magnet 420 to translate along the guide rod 422 in response to the movement of a piston magnet 416 on piston 304. As the piston 304 travels within the cylinder 306 between the cylinder rear 311 and the cylinder head 309, the piston magnet 416 translates the sliding magnet 420 proximate the piston 304.

Proximity sensors 421 may be positioned on either side of sliding magnet 420 to detect the position of the sliding magnet. The magnet 420 may be detected by the proximity sensors 421 as the magnet approaches thereby indicating the position of the piston 304. Therefore, the Hall Effect sensor 448 may provide a specific electrical and/or visual indication of the piston 304 and the rod 308 position or location. Thus, the location of the rams 202 (as shown in FIG. 3) may also be determined. The location detected by the Hall Effect sensor 448 may be passed to the ROV 121 and/or the surface unit 126 (FIG. 1) to provide an indication of the location of the piston 304 and the ram 202. The sensor S may also be operatively coupled to the monitoring system 103*h* to provide an electrical and/or visual indication of the position detected by the proximity sensor 421. The sensor S may pass the signal to various components for communicating a position of the Hall Effect sensor 448.

FIG. 4I depicts an actuator 300*i* and a BOP monitoring system 103*i* as a moving magnetic sensor 450. The moving magnetic sensor 450 may have one or more magnetic indicators (or filings) 452 located within a transparent case 454. The transparent case 454 may be, for example, a tube located on the outside of the side 307 of the cylinder 306. Each of the magnetic indicators 452 may be secured within the transparent case 454 proximate the cylinder 306 in a manner that allows the magnetic indicator 452 to translate within the transparent case 454 in response to the movement of the piston magnet 416. As shown in FIG. 4I, the magnetic indicator 452 is a plurality of magnetic shavings. However, the magnetic indicator 452 may be any suitable indicator such as one or more magnetic ball(s) (as shown in FIG. 4J).

The transparent case 454 may have any suitable form for allowing the magnetic indicator 452 to travel. The transparent case 454 may be transparent to allow for visual inspection of the location of the magnetic indicator 452, as the magnetic indicator 452 travels within the transparent case 454. The magnetic indicator 452 may be used to provide a visual indication of the location of the piston 304 and the rod 308. As the piston 304 travels within the cylinder 306 between the cylinder rear 311 and the cylinder head 309, a piston magnet 416 on piston 304 translates the magnetic indicator 452 through the transparent case 454 to a position proximate the piston 304. The magnetic indicator 452 location may be used to determine the location of the piston 304 and the rod 308. Thus, the location of the rams 202 (as shown in FIG. 3) may also be determined. The sensor S may also be operatively coupled to the monitoring system 103*i* to provide an electrical and/or visual indication of the position detected by the magnetic indicator 452. The sensor S may pass the signal to various components for communicating a position of the piston 304.

FIG. 4J depicts an actuator 300*j* with a BOP monitoring system 103*j* as another moving magnetic sensor 453. The monitoring system 103*j* is similar to the monitoring system 103*i*, except that the transparent case 454 as shown in FIG. 4J may be a transparent race (or tube) for receiving the magnetic indicator 453 and allowing it to translate therein. The magnetic sensor 453 may be, for example, a ball that rolls through the transparent race as the piston moves within the cylinder 306.

As the piston 304 travels within the cylinder 306 between the cylinder head 309 and the rear 311 of the BOP 108, the piston magnet 416 translates the magnetic indicator 453 proximate the piston 304. The magnetic indicator 453 location within the transparent tube may be used to provide a visual indication of the location of the piston 304 and the rod 308. Thus, the location of the rams 202 (as shown in FIG. 3) may also be determined. The magnetic indicator 453 location may be used to determine the location of the piston 304 and the rod 308. Thus, the location of the rams 202 (as shown in FIG. 3) may also be determined. The sensor S may also be operatively coupled to the monitoring system 103*j* to provide an electrical and/or visual indication of the position detected by the magnetic indicator 453. The sensor S may pass the signal to various components for communicating a position of the piston 304.

FIGS. 4K-4N depict various configurations of a pulley monitor 103*k,l,l'*. FIGS. 4K-4M depict longitudinal cross-sectional views of an actuator 300*k,l,l'*, and FIG. 4N depicts an end view thereof. FIG. 4K depicts an actuator 300*k* and a BOP monitoring system 103*k* as a gear drive sensor 456. The gear drive sensor 456 may have a gear drive housing 458 coupled to the cylinder rear 311. The gear drive housing 458 may have a cable (or flexible member) 460 that is placed into the cylinder 306 through an aperture 438 therein. The cable 460 may couple to the piston 304 and travel therewith as the piston 304 travels within the cylinder 306. A pulley 469 may be provided to drive the gears 462 as the cable 460 moves with the piston 304.

As the piston 304 moves from the un-actuated position to the actuated position, the cable 460 may be pulled by the piston 304. The cable 460 movement may rotate one or more gears 462 located within the gear drive housing 458. One of the gears 462 may couple to and/or rotate a first portion of a magnetic coupler 464 located within the gear drive housing 458. The first portion of the magnetic coupler 464 may magnetically couple to a second portion of the magnetic coupler 466 located outside of the gear drive housing 458.

The rotation of the second portion of the magnetic coupler 466 may be measured and used to determine the location of the piston 304 as it travels within the cylinder 306. An indicator arrow 467 may be positioned on the magnetic coupler 466 and rotated therewith. The position of the indicator arrow 467 may be used as an electrical and/or visual indicator to indicate the position of the piston 304. As shown in FIG. 4N, the indicator arrow may rotate to a position along the second portion of the magnetic coupler 466. The rotational position of the indicator arrow 467 may correlate to a position of the piston in cylinder 306.

The gears 462 may be spring wound in order to retract the cable 460 when the piston 304 travels from the actuated position to the un-actuated position. The piston 304 location as visually indicated by the indicator arrow 467 may be used to determine the location of the piston 304 and rod 308. Thus, the location of the rams 202 (as shown in FIG. 3) may also be determined.

FIG. 4L depicts an actuator 300*l* with a BOP monitoring system 103*l* as a pulley drive. In the system 103*l* as shown in FIG. 4L, the cable 460 wraps around a first pulley 469 and a second pulley 468 within the pulley housing 458. Thus, as the piston 304 moves within the cylinder 306, the pulley 468 is rotated. The pulley 468 may couple to the first portion of the magnetic coupler 464 located within the pulley housing 458. The first portion of the magnetic coupler 464 may magnetically couple to the second portion of the magnetic coupler 466 located outside of the pulley housing 458.

The rotation of the second portion of the magnetic coupler 466 may be measured and used to determine the location of the piston 304 and the rod 308 as it travels within the cylinder 306 in a similar manner as that described for FIG. 4K. As also described with respect to FIG. 4K, the indicator arrow 467 may be used to provide an electrical and/or visual indication of the piston 304. Thus, the location of the rams 202 (as shown in FIG. 3) may also be determined.

FIG. 4M depicts an actuator 300*l'* with a BOP monitoring system 103*l'* as a pulley drive. The actuator 300*l'* is similar to the actuator 300*l*, except that the pulley housing 458 and contents are rotated 90 degrees, and the pulley housing 458 is integral with the cylinder 306. As indicated by FIG. 4M, the visual indicators (or monitors) herein may be positioned at various locations about the cylinder 306 to facilitate viewing thereof. As also indicated by FIG. 4M, the visual indicators (or monitors) may be positioned in housings integral with the cylinder 306 (or separate from as shown by FIGS. 4K and 4L).

The rotation of the second portion of the magnetic coupler 466 may be measured and used to determine the location of the piston 304 and the rod 308 as it travels within the cylinder 306 in a similar manner as that described for FIG. 4K. As also described with respect to FIG. 4K, the indicator arrow 467 may be used to provide a visual indication of the piston 304. Thus, the location of the rams 202 (as shown in FIG. 3) may also be determined.

The movement of arrow 467 may be detected by a sensor S. The sensor S may also be operatively coupled to the monitoring system 103*k-m* to provide an electrical or visual indication of the position of the arrow 467. The sensor S may pass the signal to various components for communicating a position of the piston 304.

FIGS. 5A-5D depict alternate schematic, cross-sectional views of an actuator 300*m-p* having various versions of a monitoring system 103*m-p* usable as the actuator 300 and BOP monitoring system 103 of FIG. 3 and depicting the operation thereof. As shown in each of these figures, the piston 304 is slidably movable within the cylinder 306. In these figures, for simplicity, the rod 308 is not shown. The monitoring systems 103*m-p* are each positionable about the cylinder 306 and have devices for detecting a position of the piston 304 therein. Each piston 304 is operatively connectable to a ram 202 (see FIGS. 2 and 3) and, therefore, a position of the rams 202 (and/or components thereof) may also be determined. In each of these monitoring systems 103*m-p*, a sensor S may also be operatively coupled to the monitoring system 103*m-p* to provide an electrical and/or visual indication of the detected position of the piston 304. The sensor S may pass the signal to various components for communicating a position of the piston 304. A visual indicator, such as those provided herein, may also optionally be coupled to the monitoring system 103*m-p* to provide a visual indication of position upon activation by the monitoring system.

Figure 5A:
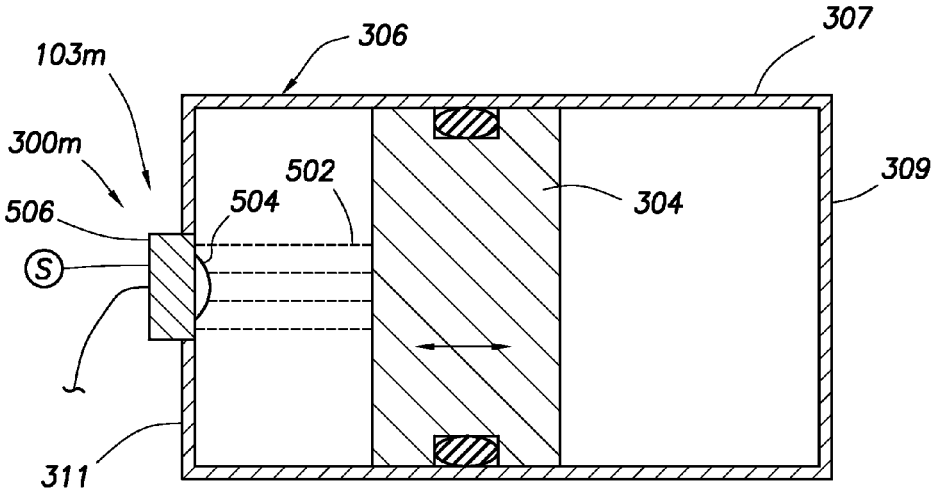
FIGS. 5A-5D show schematic cross-sectional views of additional versions of an actuator and a monitoring system operatively connected thereto.

FIG. 5A depicts an actuator 300*m* and a BOP monitoring system 103*m* as a capacitive displacement sensor 506. The capacitive displacement sensor 506 may flow a current 502 within the cylinder 306. The current 502 may be sent into the cylinder 306 with one or more source electrodes 504 coupled to the cylinder rear 311.

A sensor electrode 506 may detect the current after the current has engaged the piston 304. Changes in the current detected by the sensor electrode 506 may be used to determine the distance of the piston 304 from the cylinder rear 311. The piston 304 location may be used to determine the location of the piston 304 (and the rod 308 not shown). Thus, the location of the rams 202 (as shown in FIG. 3) may also be determined.

Figure 5B:
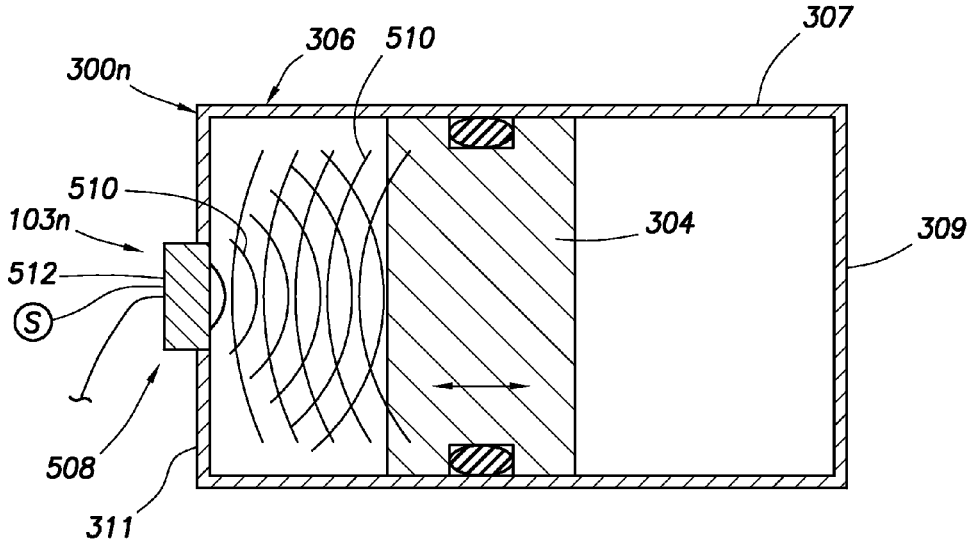

FIG. 5B depicts an actuator 300*n* and a BOP monitoring system 103*n* as a sonar sensor 508. The sonar sensor 508 may produce a sonic wave 510 within the cylinder 306. The sonic wave 510 may be propagated into the cylinder 306 and reflected off of the piston 304. The reflected sonic wave 510 may be detected by a receiver 512.

Changes in the detected sonic wave 510 may be used to determine the distance of the piston 304 from the cylinder rear 311. The piston 304 location may be used to determine the location of the piston 304 (and rod 308 not shown). Thus, the location of the rams 202 (as shown in FIG. 3) may also be determined.

Figure 5C:
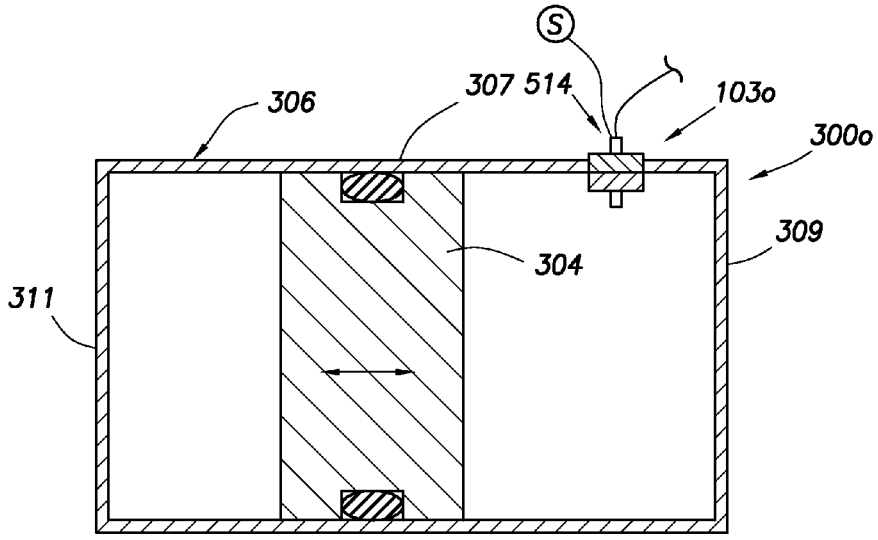

FIG. 5C depicts an actuator 300*o* and a BOP monitoring system 103*o* as one or more proximity sensor(s) 514. The proximity sensor(s) 514 may be any suitable detection sensor that determines the location of the piston 304 within the cylinder 306. For example, the proximity sensor 514 may be a mechanical sensor such as a button or a switch, an electrical sensor such as a strain gauge, a sonar sensor, and the like. The proximity sensor 514 may be coupled to, for example, the ROV 121 or surface unit 126.

The proximity sensor(s) 514 may detect the location of the piston 304 when the piston 304 is in the actuated and/or un-actuated position. There may also be multiple proximity sensor(s) 514 along the cylinder 306 in order to give the location of the piston 304 as the piston 304 translates within the cylinder 306. The piston 304 location may be used to determine the location of the piston 306 (and rod 308 not shown). Thus, the location of the rams 202 (as shown in FIG. 3) may also be determined.

Figure 5D:
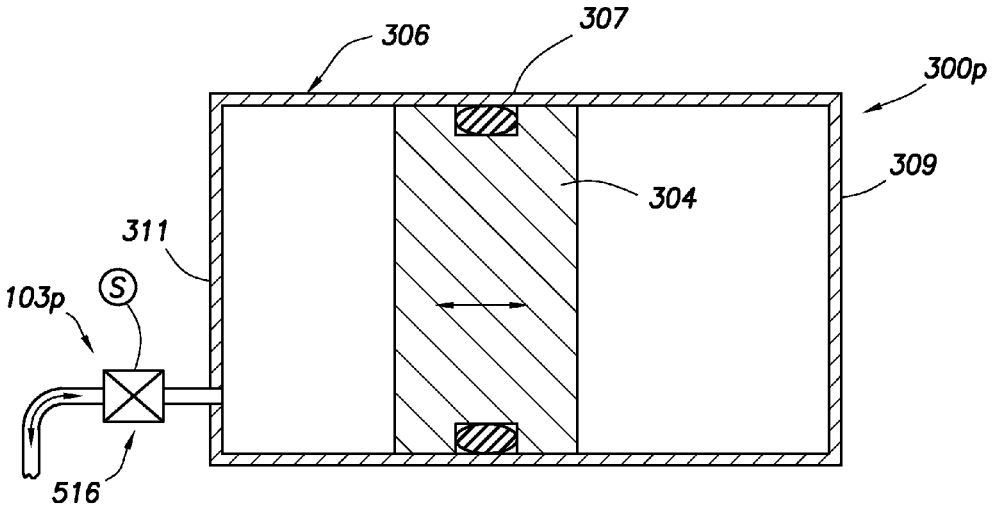

FIG. 5D depicts an actuator 300*p* and a BOP monitoring system 103*p* as a flow sensor 516. The flow sensor 516 may be, for example, a totalizing mechanical flow meter configured to measure the flow into and/or out of the cylinder 306 as the piston 304 is extended and retracted. The flow sensor 516 may be coupled to a fluid source, such as a tank (not shown). Pumps, flowlines or other fluid devices may be provided to assist in manipulating the flow of fluid through the flow sensor 516.

With the inner volume of the cylinder known, the hydraulic flow into the cylinder may be used to calculate the position of the piston 304 within the cylinder. Alternatively, when the piston 304 is retracted toward the un-actuated position, the mechanical flow meter may reset back to zero instead of measuring the outflow. The piston 304 location may be used to determine the location of the piston 304 (and rod 308 not shown). Thus, the location of the rams 202 (as shown in FIG. 3) may also be determined.

Each of the monitors 103*a-p* depicted in FIGS. 4A-4N, 5A-5D may be used to indicate a position of the piston 304. These monitors 103*a-p* may be coupled via a communication link (e.g., 134 of FIG. 1) to the ROV 121 and/or surface unit 126 for passing signals therebetween. Such signals may contain data that may indicate (or be analyzed to indicate) the position of the piston 304. Some of the monitors 103*a-p* may provide visual indicators (e.g., monitors 103*b-c,i-l*), such as the flags 412 of FIG. 4B, magnets 420 of FIGS. 4C and 4H, magnetic indicators 452, 453 of FIGS. 4I and 4J, that may be visually inspected by an operator, ROV, camera or other devices to determine a position of the piston. The visual indicators may also be provided with visual indicator sensors to electrically indicate a position of the sensors. Some of the monitors 103*a-p* may provide trigger sensors having electrical indicators (e.g., monitors 103*a,d-h,m-p*) that may send signals to the surface unit indicating a position of the piston. One or more cylinders 306 of a BOP 108 may be provided with one or more of the monitors 103*a-p* about various locations.

Figure 6:
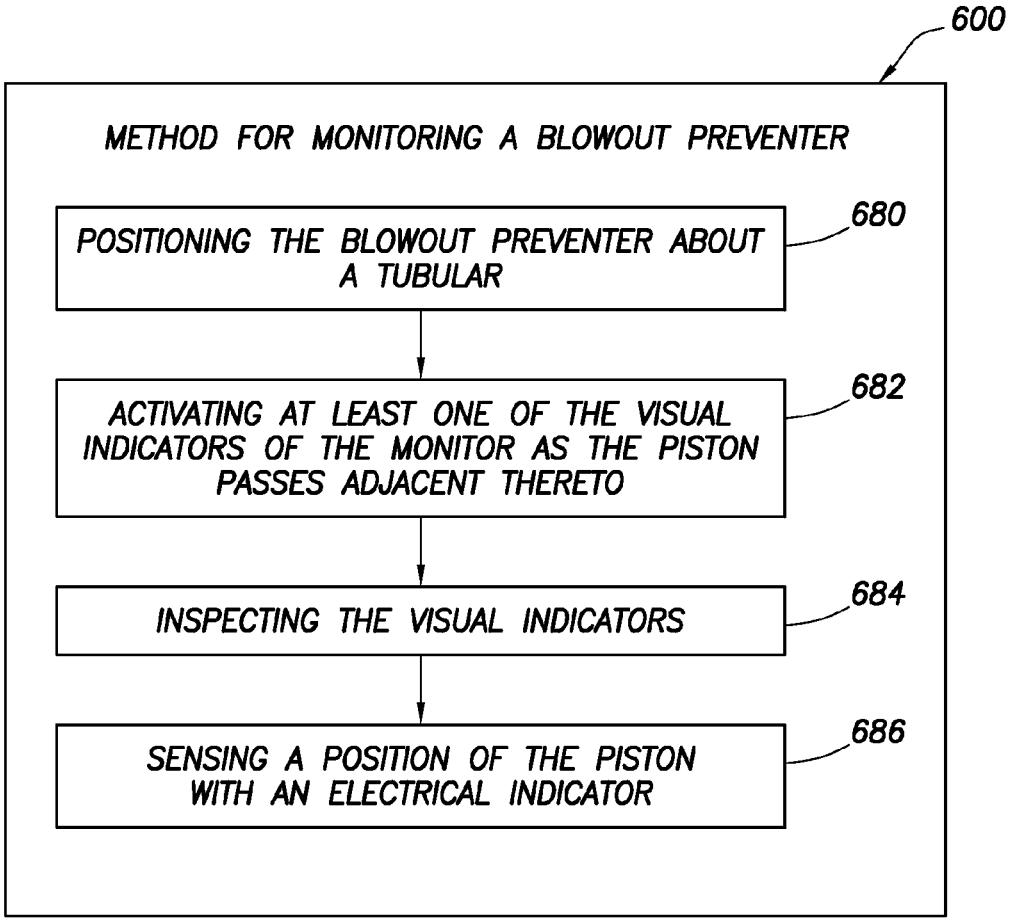
FIG. 6 depicts a method of monitoring a BOP.

FIG. 6 is a flow chart depicting a method (600) for monitoring a blowout preventer. The method (600) involves positioning (680) the blowout preventer about a tubular, activating (682) at least one of the visual indicators of the monitor as the piston passes adjacent thereto, inspecting (684) the visual indicators, and sensing (686) a position of the piston with an electrical indicator. The inspecting may also involve manually viewing the visual indicators and/or sensing the visual indicators for activation. The method may also involve additional steps, such as passing data from the monitor to a surface unit. The steps may be performed in an order, and repeated as desired.

Blowout Preventer Monitor with Trigger Sensor

Figure 7:
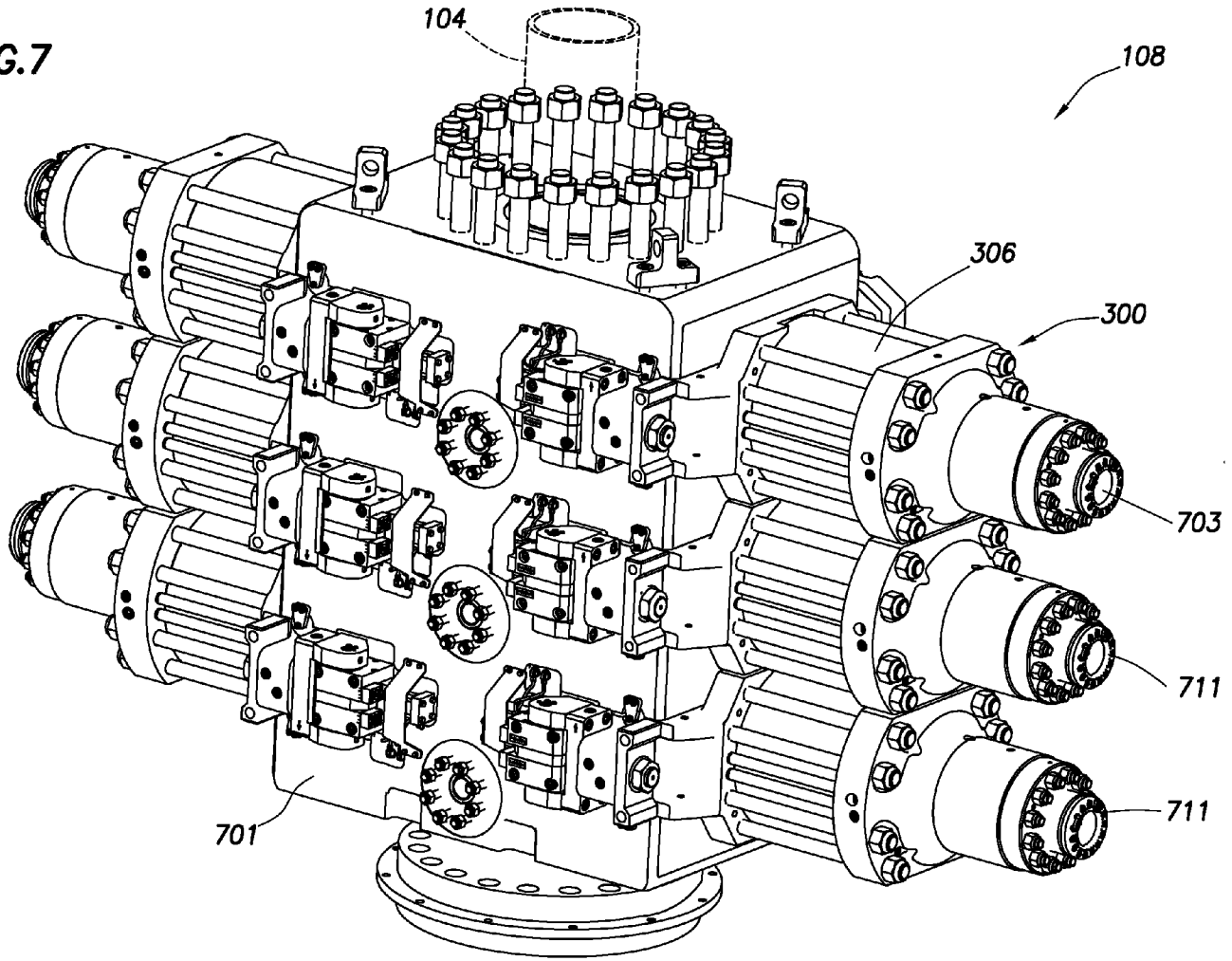
FIG. 7 depicts a schematic view of a BOP with actuators and a BOP monitor.

FIG. 7 is another view of the BOP 108. This version includes a BOP housing 701 with multiple rams 202 (FIG. 3) with corresponding actuators 300. Each actuator 300 includes the cylinder 306 with an end cap (or ram door) 711 removable about an end thereof. An upper one of the end caps 711 has been replaced with a BOP monitor (or ram position indicator) 703. In some cases, the BOP monitor 108 is a BOP monitoring system or a portion thereof.

The BOP monitor 703 may track the movement of a BOP ram 202 passing through the BOP 108 in the same way as shown in FIGS. 2 and 3. As the ram 202 moves to engage the tubular 104, the BOP monitor 703 is activated to monitor movement thereof and/or to determine a position thereof. The BOP monitor 703 may be used to determine the displacement of the ram 202, and thus its position in the BOP 108.

Figure 8:
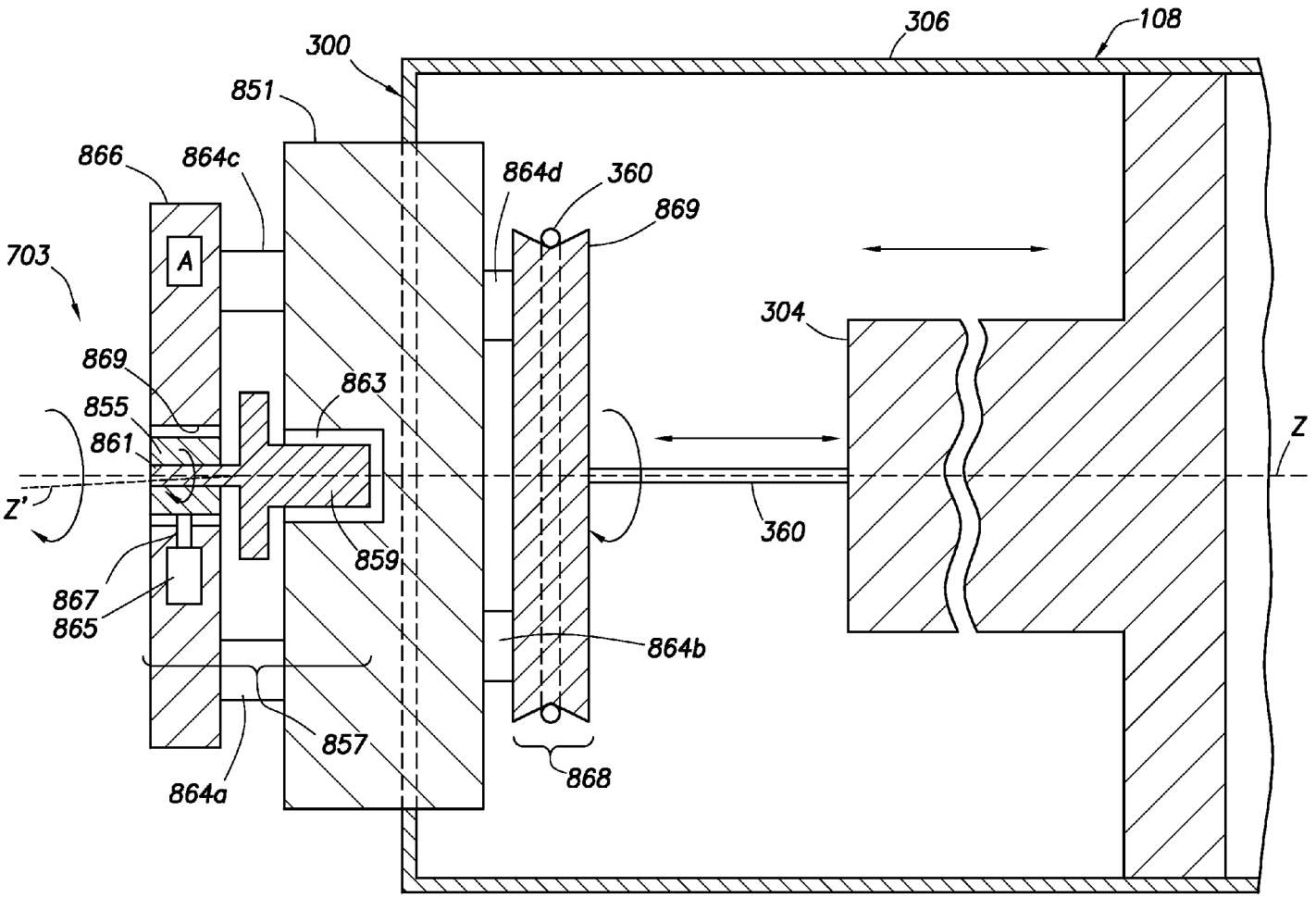
FIG. 8 is a schematic view of a portion of the BOP depicting a BOP monitor therein, the BOP monitor including a monitor base, interior and exterior plates, and a trigger sensor.

FIG. 8 shows a portion of the BOP 108 depicting the actuator 300 including the piston 304 slidably positionable in the cylinder 306. The end cap 711 (FIG. 7) of the cylinder 306 has been removed and replaced with the BOP monitor 703. The BOP monitor 703 is removably positionable about an exterior end of the cylinder 306 with a portion thereof positioned within the cylinder 306 and a portion positioned outside the cylinder 306.

The BOP monitor 703 includes a monitor base 851, an interior plate 868, an exterior plate 866, and a trigger sensor 857. The monitor base 851 is removably positioned about the end of the cylinder 306. The monitor base 851 may be, for example, threadedly disposed in the cylinder 306 or bolted thereto. The monitor base 851 may seal the cylinder 306 in the same manner as did the end cap 711 removed therefrom.

The interior plate 868 may be rotationally coupled along an inner surface of the monitor base 851. The interior plate 868 may include a pulley wheel 869 with a cable 360 disposed about a perimeter thereof. The cable 360 may couple the piston 304 to the interior plate to translate movement therebetween. Movement of the piston 304 within the cylinder 306 may extend and retract the cable 360. As the cable 360 extends and retracts, the interior plate 868 may rotate therewith.

Because the base 851 replaces the end cap (ram door) 711, the exterior plate 866 and interior plate 868 may be connected to the base 851 on either side thereof. The exterior plate 866 may be disposed outside of the end cap (ram door) 711 of ram cylinder 306 of the BOP 108. Interior plate 868 may be disposed inside of the end cap (ram door) 711. The exterior plate 866 and interior plate 868 may rotate about the base 851 as the ram 202 (FIG. 2 or 3) of the BOP 108 moves therein.

The exterior and interior plates 866, 868 may be positioned on opposite sides of the base 851 and offset axially relative to each other by some distance. The exterior plate 866 and the interior plate 868 may be fixed axially such that they do not move in the axial direction and such that they may be free to independently rotate about a centerline axis Z. The exterior plate 866 and the interior plate 868 may be, for example, metal (e.g., steel) plates that are circular in shape. However, the exterior and interior plates 866, 868 may take another shape in other embodiments. The axial centerline Z of the exterior plate 866 and the interior plate 868 may be aligned as represented in FIG. 8 by the single axial centerline Z.

The exterior plate 866 may be rotationally coupled along an exterior surface of the monitor base 851. Magnets 864*a-d* may be matingly positioned about the interior plate 868 and the exterior plate 866 for magnetic interaction therebetween. The magnets 864*a,c* of the exterior plate 866 and magnets 864*b,d* of the interior plate 868 are magnetically engagable through the monitor base 851 to provide a magnetic coupling therebetween. The magnetic coupling may be used to transfer rotation of the interior plate 868 through monitor base 851 to the exterior plate 866 as indicated by the dual rotational arrows. Magnets 864*a-d* may be any magnet capable of transferring rotation between the exterior plate 866 and the interior plate 868, such as N50/52 magnets or other functionally equivalent types of magnets.

The monitor base 851 may be used to fluidly isolate the trigger sensor 857 on an exterior of the cylinder 306. The interior plate 868 is coupled to the piston 304 within the cylinder 306. The exterior plate 866 is outside the cylinder and magnetically coupled to the interior plate 868 via magnets 864 *a-d*. This configuration may be used to permit rotation of the exterior plate 866 outside the cylinder 306 (and BOP 108) using a mechanically detached coupling, such as magnets 864*a-d* to translate movement from inside the cylinder 306 to an exterior of the cylinder 306.

Figure 9A:
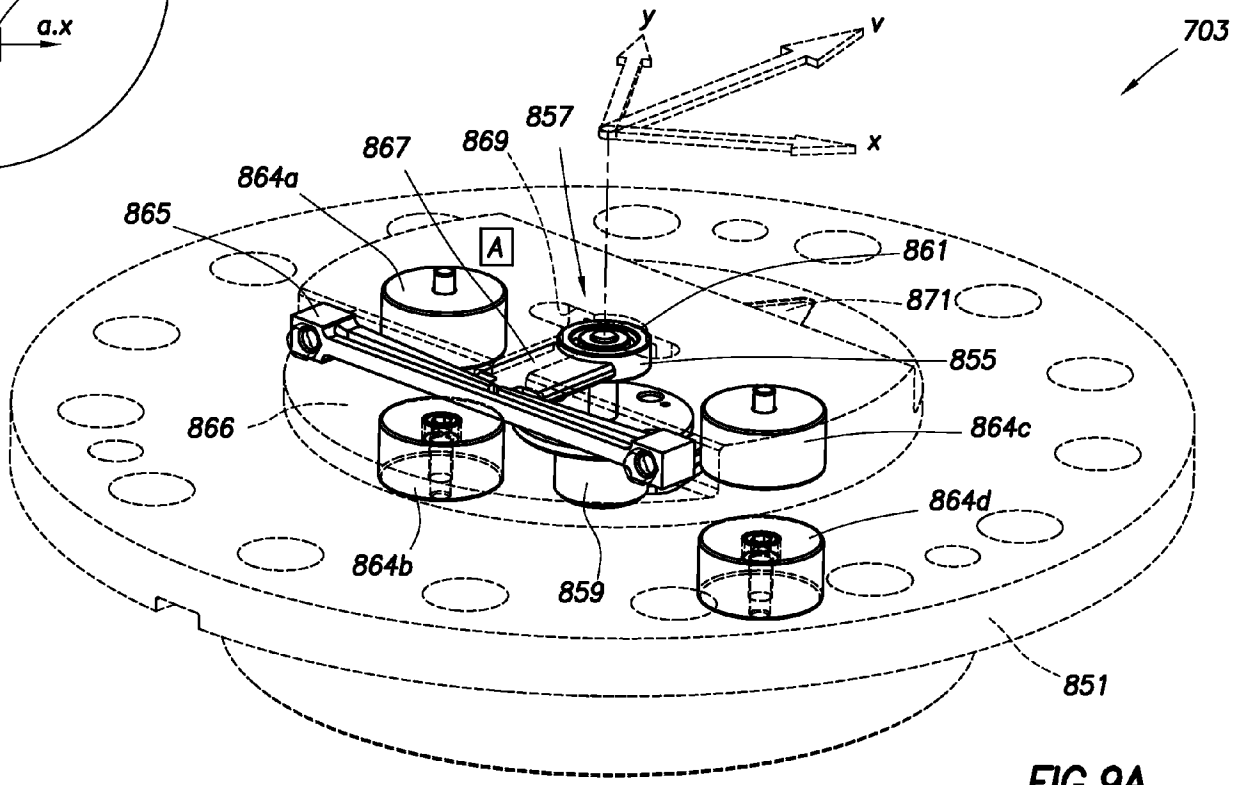
FIG. 9A is a schematic diagram depicting the trigger sensor of the BOP monitoring system.

FIG. 9A shows another view of the BOP monitor 703 depicting the trigger sensor 857 therein. As shown FIGS. 8 and 9, the trigger sensor 857 is disposed about the exterior plate 866 and the monitor base 851. To depict the trigger sensor 857, the exterior plate 866 and the monitor base 851 have been shown in dashed line. The trigger sensor 857 includes a sensor base 859 with a rod 861 extending therefrom, a trigger (or loading device) 865 with a plunger (or push block) 867 extending therefrom, and a bearing 855. The sensor base 859 is positioned in a sensor pocket 863 extending into the exterior surface of the monitor base 851. The rod 861 extends from the sensor base 859 and into a trigger pocket 869 in the exterior plate 866. The bearing 855 is positioned in the trigger pocket 869 and has a hole to receive a tip of the sensor rod 861 therein. The bearing 855 may have an exterior ring positionable in the exterior plate 866 engagable by the plunger 867, and an inner ring to receive a tip of the rod 861 therein. The trigger 865 is positioned on the exterior plate 866 with the plunger 867 engagable with the bearing 855.

The trigger sensor 857 as depicted may be a strain rosette or strain gauge. The trigger sensor 857 detects movement of the exterior plate 866 to provide a signal measurable to determine a position of the piston and, therefore, the rams. Trigger sensor 857 is coupled to exterior plate 866 at its centerpoint about axis Z. The trigger sensor 857 has a known X and Y direction. A resultant directional vector V may be determined based on a magnitude and direction of strain detected by the trigger sensor 857 in the X and Y direction. The load/force from trigger 865 is assumed to be about constant. The force produced by trigger 865 is transferred to the sensor base 859 through the plunger 867, bearing 855, and the sensor rod 861.

The sensor rod 861 deflects in the direction of the force produced by the trigger 867 and this deflection is measured in the sensor base 859 via strain gage methods. A change in direction of the force also changes the direction that the sensor rod 861 deflects, which is measurable by the sensor base 859 as the exterior plate 866 rotates. This change in direction may be used to determine a vector angle of the load which may be used to determine an angle of the exterior plate 866. Given the known geometry of the BOP monitor 703, the angle of the exterior plate 866 may be used to determine a ram position.

Figure 9B:
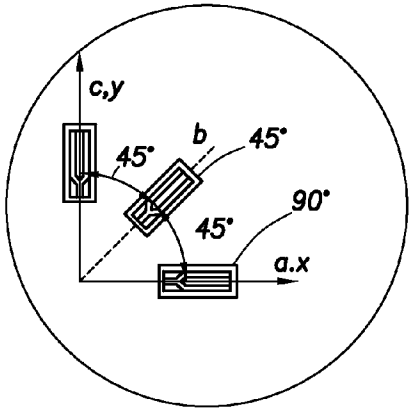
FIG. 9B is a schematic diagram depicting operation of the trigger sensor at various angles.

Trigger sensor 857 may be, for example, a strain gauge capable of measuring strain along multiple axes, such as three axes, as schematically illustrated in FIG. 9B. The 0° strain gauge measures strain along the Y-axis, the 90° measures strain along the X-axis, and the 45° measures a combination of the two and is used to increase accuracy. The combination of the three 0°, 90°, 45° allows for tracking the strain—magnitude and direction—as exterior plate 866 rotates due to any rotation of interior plate 868. Other configurations and angles may be used.

As also shown, an accelerometer (or other additional sensor) A may optionally be provided. Outside forces (e.g., forces other than those associated with the magnets 864*a-d*), may impact interior plate 868, causing vibration or shock loads in exterior plate 866 that may be sensed by trigger sensor 857. For example, gravity may cause a downward pull on the exterior plate 866, and vibration may affect directional load from the exterior plate 866 in any direction. Failure to consider these forces may lead to inaccurate determinations of exterior plate 866 rotation and thus ram displacement and position.

To compensate or correct for potential errors that may be caused by the outside forces (e.g., gravity and vibration) that may impact exterior plate 866 and, in turn, be sensed by the trigger sensor 857, various forces may be considered. Data from the accelerometer A may be paired with the trigger sensor 857 readings to give accurate rotation position by factoring out gravity and vibration experienced through the accelerometer A. The measurements of the trigger sensor 857 and the accelerometer A may be transferred to a controller, surface unit, or other device (see, e.g., 126, 128 of FIG. 1) for collecting and/or analyzing data.

Movement of the piston 304 extends and retracts the cable 360. Movement of the cable 360 rotates the interior plate 868. Magnets 864*b,d* of the interior plate are coupled to the magnets 864 *a,c* to translate movement of the interior plate 868 to the exterior plate 866. The tip of sensor rod 861 extends into the bearing 855 in the exterior plate 866. Plunger 867 of trigger 865 pushes the bearing 855 and the tip of the rod 861 such that the rod 861 is offset from axis Z along an offset axis Z'.

Bending/deflection of the sensor rod 861 provides measurements detectable by the sensor base 859. The sensor base 859 may be coupled to the BOP 108, controllers 126, 128, and or other devices to transfer sensed measurements thereto. The trigger sensor 857 detects movement of the exterior and interior plates 866, 868 to provide a signal measurement to determine a direction vector which may be used to determine a position of the piston.

Figure 10A:
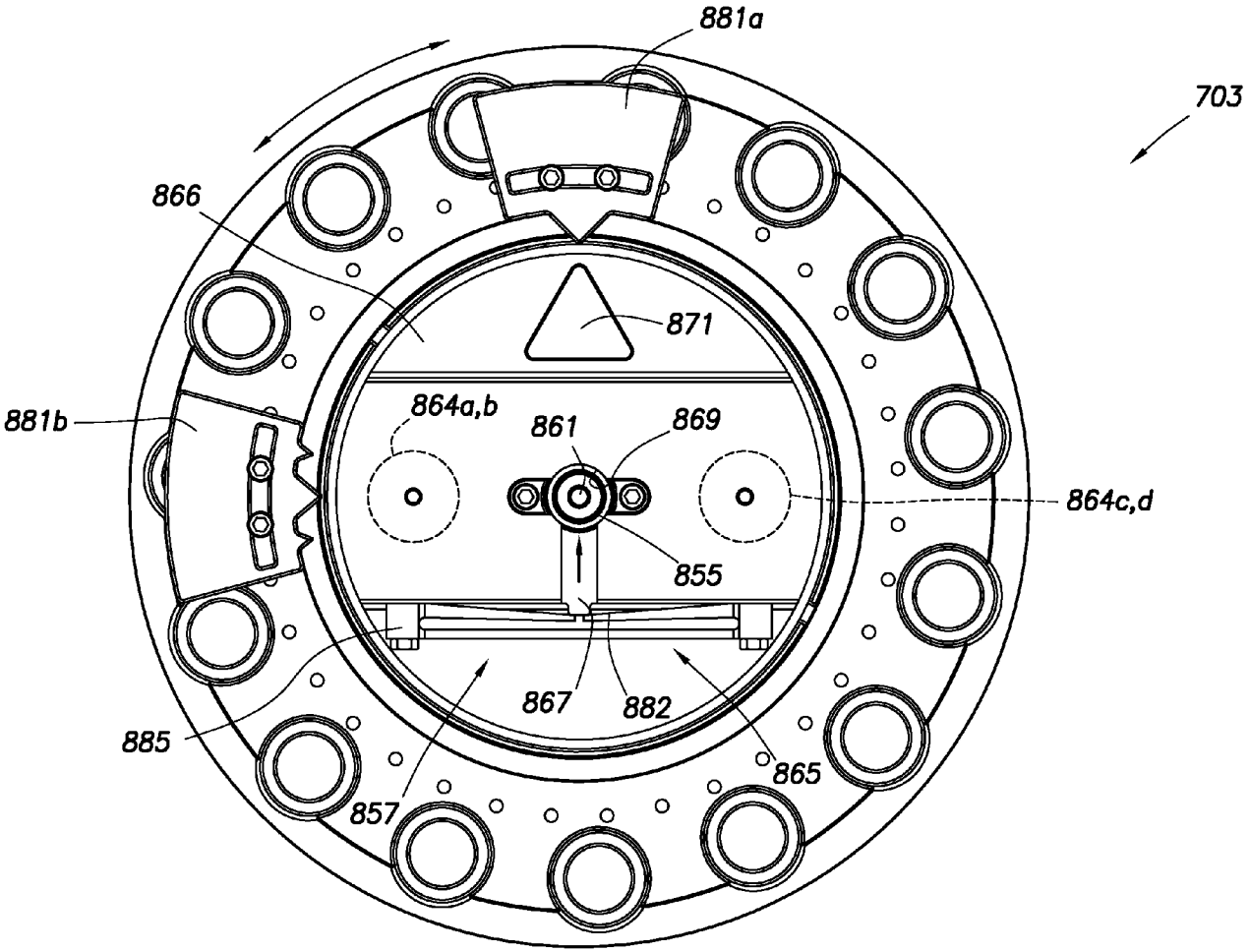
FIGS. 10A and 10B show exterior end and interior end views, respectively, of a BOP monitor.
Figure 10B:
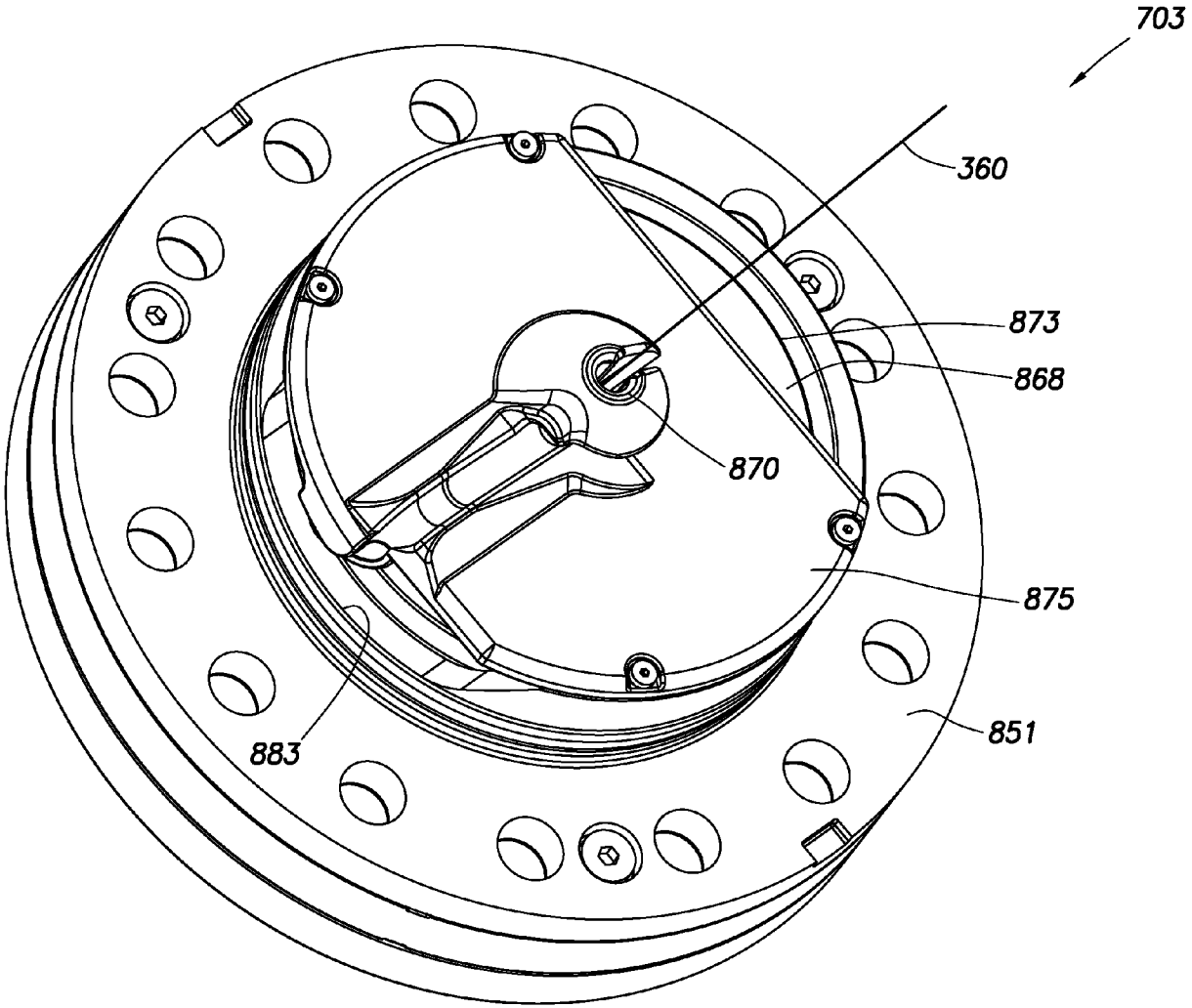

FIGS. 10A and 10B show various views of the BOP monitor 703. FIG. 10A shows an exterior end view of the BOP monitor 703. FIG. 10B shows an interior end view of the BOP monitor 703.

As shown in FIG. 10A, the BOP monitor 703 is depicted as a circular member connectable to the cylinder 306, for example, by bolts. The exterior plate 866 also has a visual indicator in the form of dial (or arrow) 871 rotatable with the exterior plate 866. The dial 871 may be similar to the dial 467 of FIGS. 4K-4N. The dial 871 and exterior plate 866 as shown are rotatable between an open and closed position as indicated by the arrow. Markers 881*a,b* may be provided to depict open and closed positions, respectively, along the exterior face of BOP monitor 703.

FIG. 10A also depicts another view of the trigger sensor 857. The trigger sensor 857 is depicted in the exterior plate 866 with the rod 861 extending into the trigger pocket 869. The trigger 865, plunger 867, and bearing 855 are depicted in the exterior plate adjacent to the rod 861. As shown in this view, the trigger 865 is a flat spring or beam 882 extending between fixed supports 885. The spring receivingly engages the plunger 867 and urges the plunger 867 toward rod 861 as indicated by the arrow. The spring 882 may include a fixed bar extending between the supports and one prong extending from each support parallel to the fixed bar. The fixed bar keeps the prongs aligned. The plunger 867 is positioned midway between the two prongs and is urged by the prongs to apply a force to the bearing 855 and rod 861 to push/deflect the rod 861 off center from axis Z (FIG. 8). As also shown in this view, the magnets 864*a,b* and 864*c,d* are aligned about exterior plate 866 and interior plate 868 (FIGS. 8 and 9A). The magnets 864*a-d* are the same distance from the axis Z.

As shown in FIG. 10B, the interior plate 868 is positioned adjacent to the base 851 and includes a pulley (or wheel) 873 and a separate cover 875. The wheel 873 has an exterior surface positionable adjacent the monitor base 851 and a perimeter to receive the cable 360 thereabout. The cover 875 is disposable about an inner surface of the pulley 873, and has a hole 870 therethrough for passing the cable 360 therethrough to connect with piston 304 (FIG. 8).

Figure 10C:
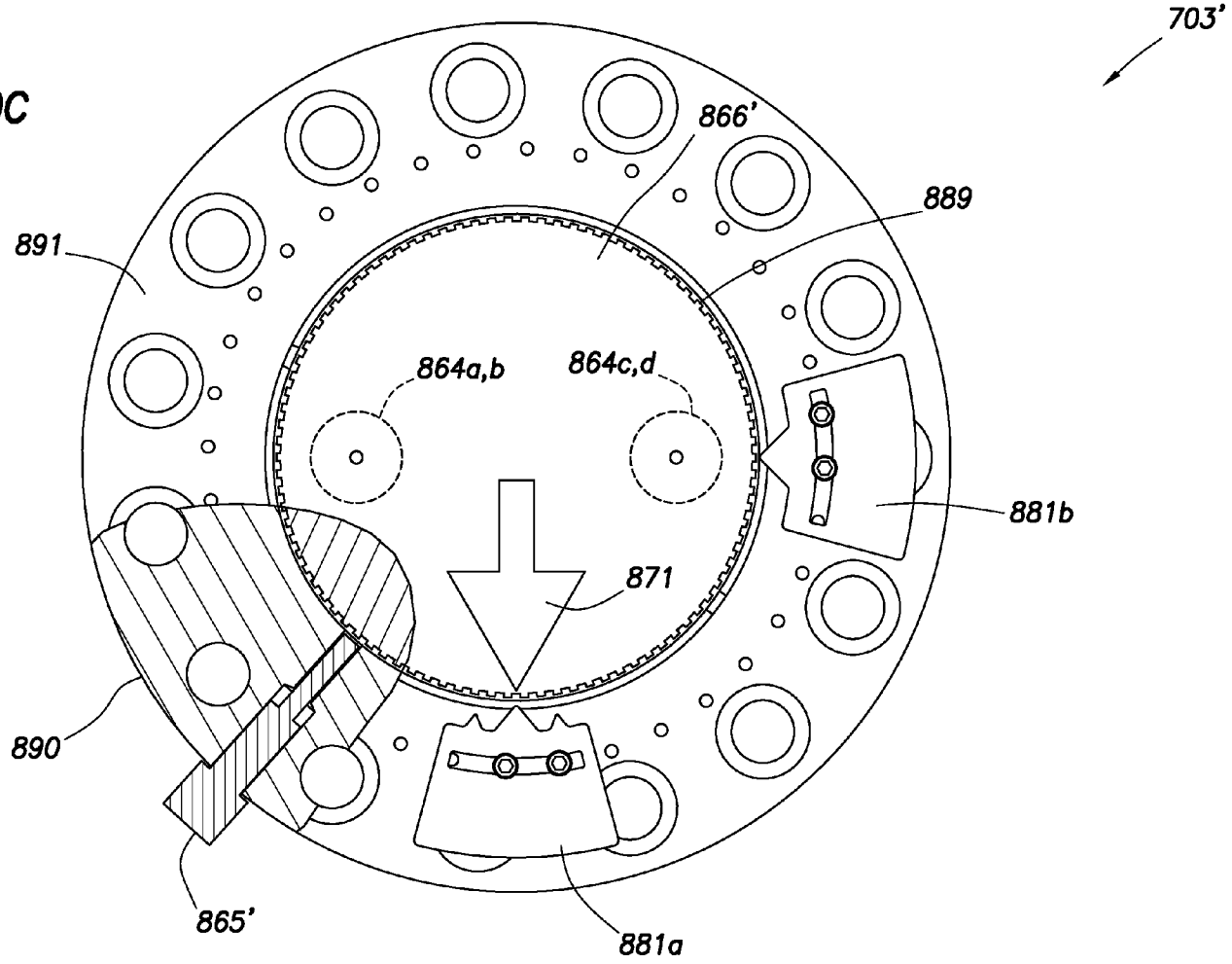
FIG. 10C shows a partial cross-sectional view of the BOP monitor.

FIG. 10C shows another version of the BOP monitor 703'. This version is the same as shown in FIG. 10A, except that a modified exterior plate 866' and sensor 865' are provided. The exterior plate 866' is disposable about an exterior cover 891 and a spacer 890. The exterior plate 866' has the visual indicator 871 thereon and has teeth 889 along a periphery thereof engagable with the sensor 865'. While teeth 889 are shown in this example, other detectable features, such as alternating light and dark bands along a periphery of the exterior plate 866' may be used.

The sensor 865' extends through the spacer 890 and to the teeth 889 on the exterior plate 866'. The sensor 865' may detect the teeth 889 as they rotate past, thereby indicating a rotational position of the exterior plate 866'. A known angle between the teeth 889 and a size of the rotating exterior plate 866' may be used to determine linear travel of the rams.

Figure 11A:
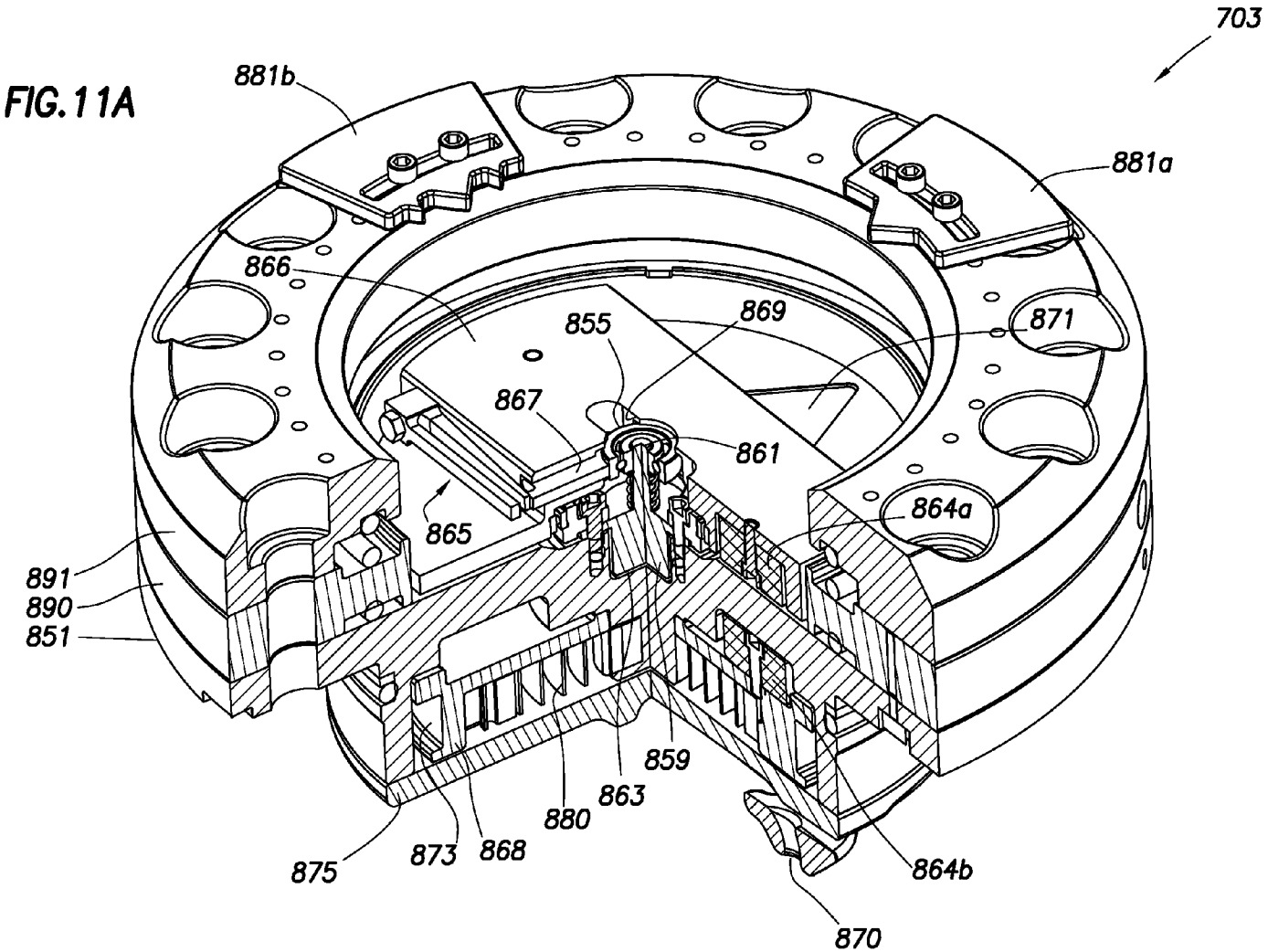
FIGS. 11A-11C show partial cross-sectional, exterior exploded, and interior exploded views, respectively, of a BOP monitor.
Figure 11B:
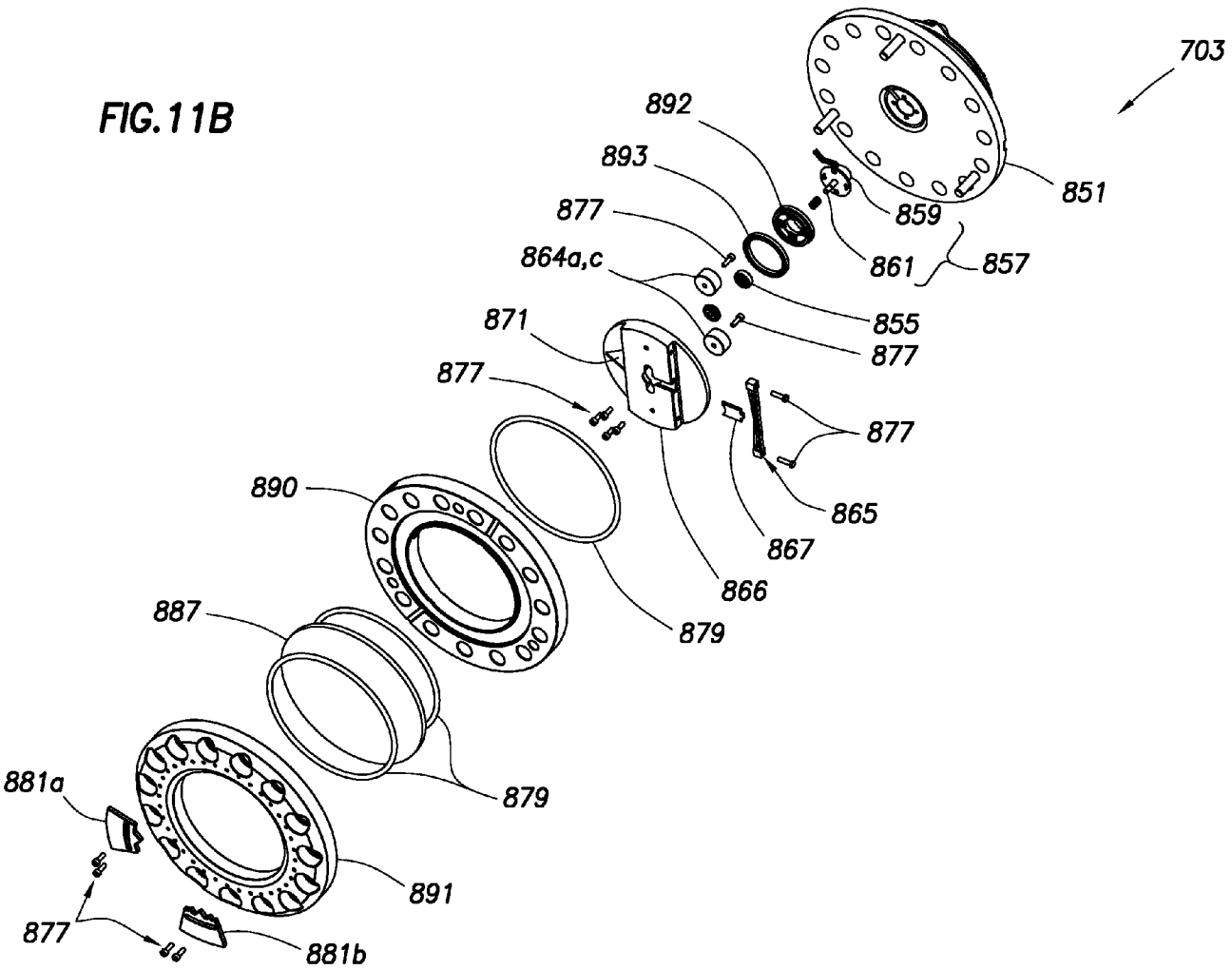
Figure 11C:
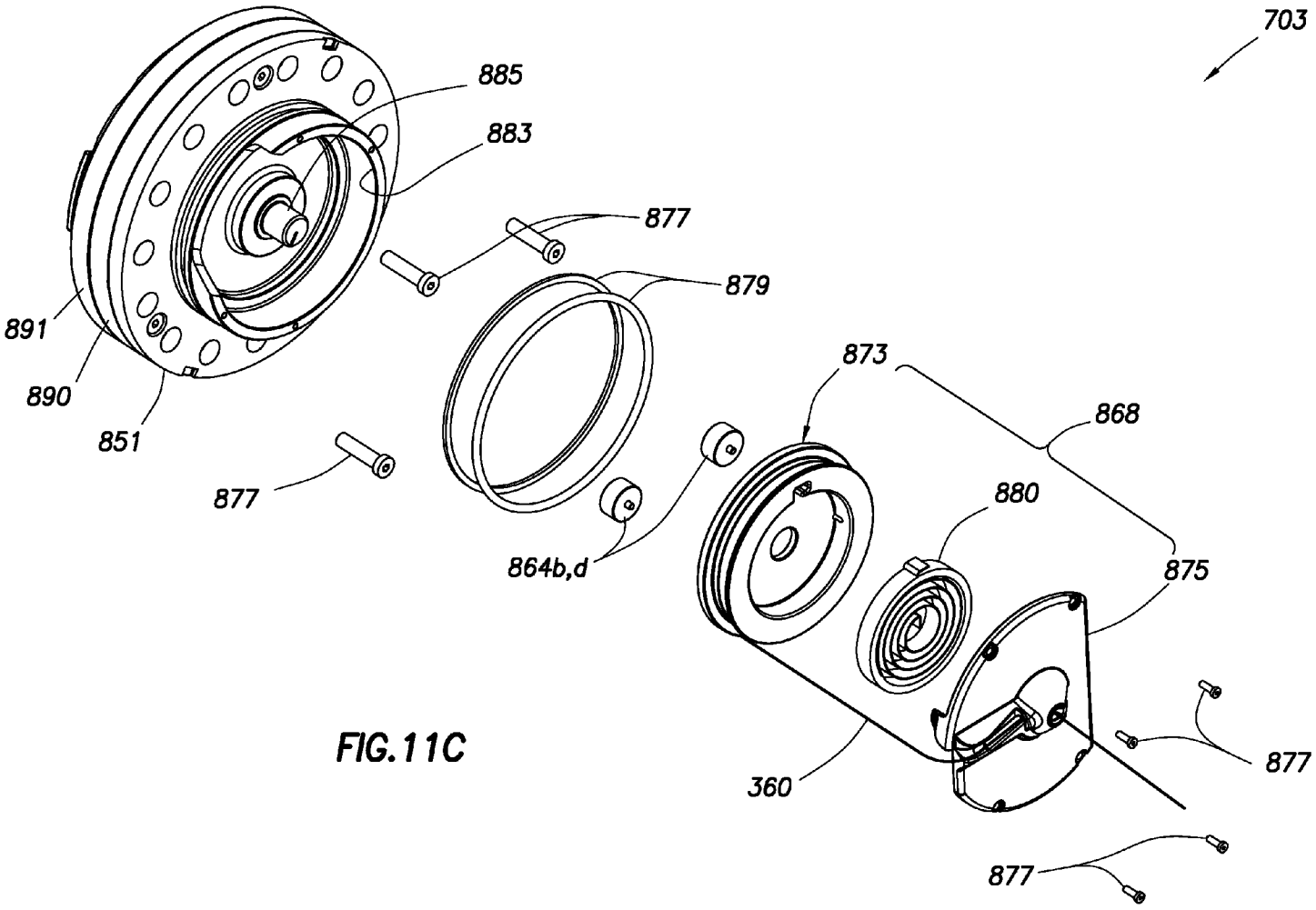

FIGS. 11A, 11B, and 11C show partial cross-sectional, exterior exploded, and interior exploded views, respectively, of the BOP monitor 703. These views show the BOP monitor 703 in an assembled and a disassembled configuration. These views also show the components of FIGS. 8, 9, and 10A, plus additional optional components, such as seals 879, a spring 880, dial cover 887, and additional connectors (e.g., bolts) 877.

Seals 879 may be used to prevent fluid leakage through the BOP monitor 703. Spring 880 may be a rotational spring that urges the interior plate 868 into a refracted position to retract the cable 360 from the piston 304 and to keep the cable 360 taught (FIG. 8). Dial cover 887 may be a clear cover to protect the exterior plate 866 and dial 871 and/or seal the sensor 865 in the exterior cover 891. Various connectors, such as bolts may be provided between various portions of the BOP sensor 703 to secure such portions in place. The sensor base 859 with rod 861 thereon may be adjustably mounted in the monitor base 851 by bolts.

As also shown in FIG. 11B, the exterior plate 866 may mount to a bearing 893 which is mounted to an adapter 892 which bolts to the monitor base 851. The exterior plate 866 is free to rotate around the sensor rod 861 using bearing 893. Dial (or visual indicator) 871 is positioned on exterior plate 866. As also shown in FIG. 11C, the monitor base 851 is provided with an interior pocket 883 and a shaft 885 on an interior side thereof to receive the interior plate 868.

Figure 11D:
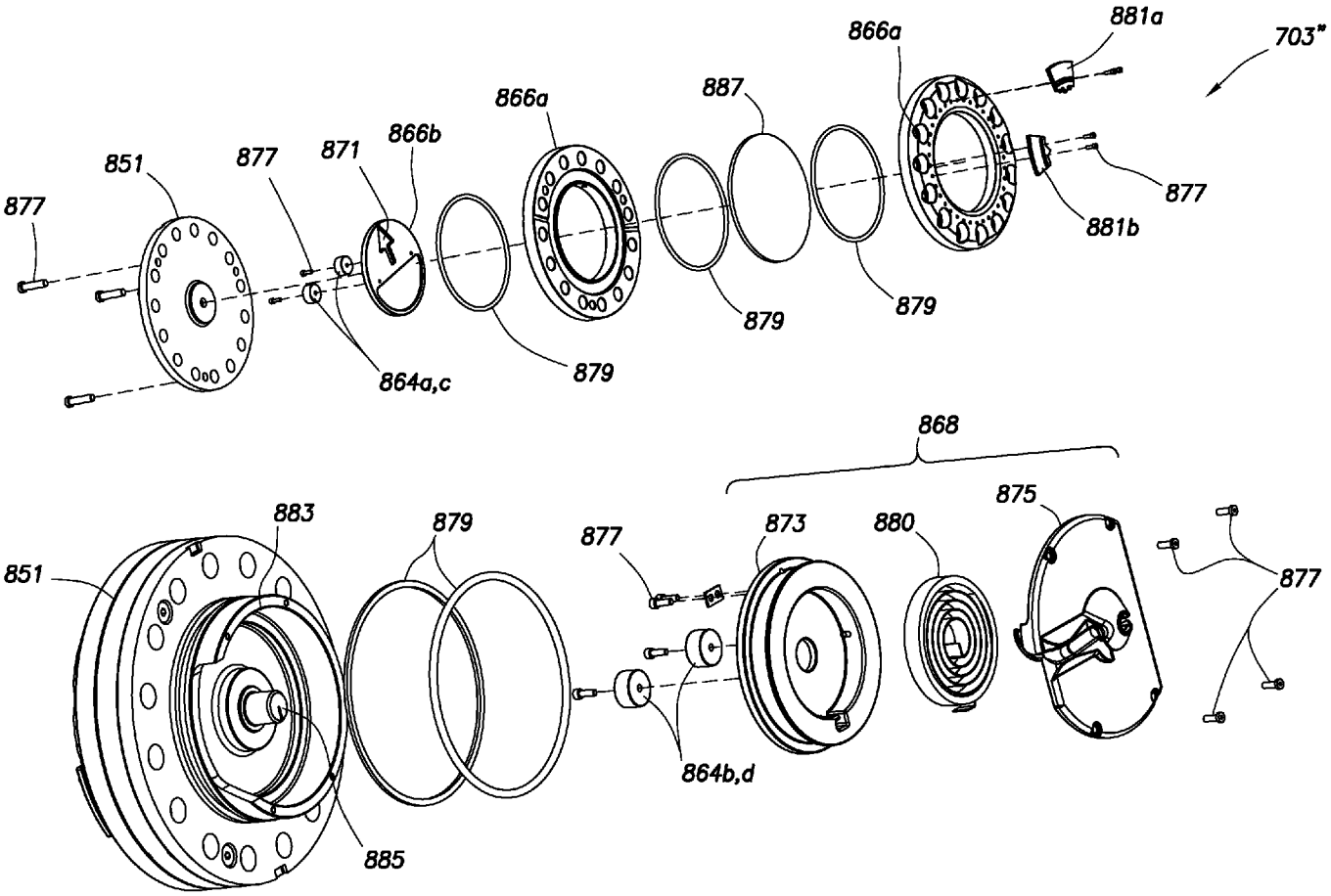
FIG. 11D shows an exploded view of an alternate version of the BOP monitor.

FIG. 11D also shows an alternate configuration of the BOP monitor 703" which is similar to the BOP monitor 703 of FIGS. 11A and 11B, except that the exterior plate 866 includes two exterior covers 866*a*, a dial plate 866*b*, and a spacer 866*c*".

Figure 13B:
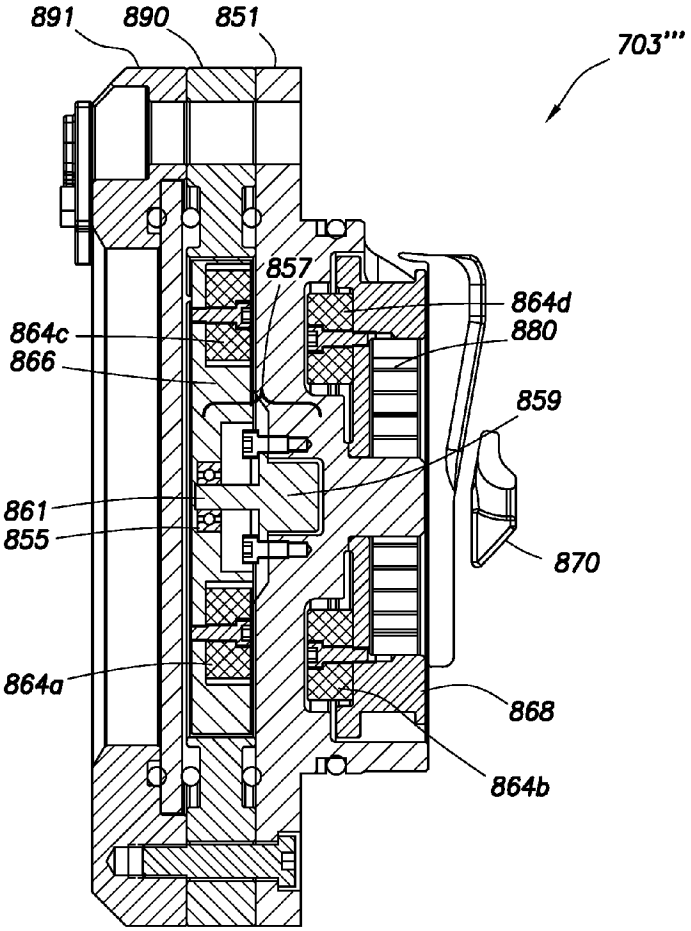
FIG. 13B is a cross-sectional view of the BOP monitor of FIG. 12A2 taken along line 13B-13B.
Figure 13A:
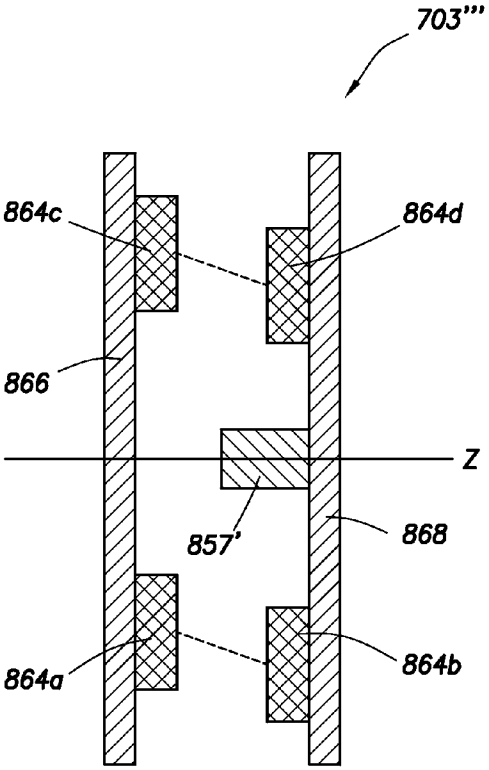
FIG. 13A is a cross-sectional view of the BOP monitor of FIG. 12A1 taken along line 13A-13A.

FIGS. 12A1, 12A2, 12B1, 12B2, 13A, and 13B show schematic views of another version of the BOP monitor 703'''. FIGS. 12A1 and 12A2 show views of the BOP Monitor 703''' in a zero or initial position. FIGS. 12B1 and 12B2 show views of the BOP monitor 703''' rotated α degrees (e.g., about 45 degrees clockwise). The BOP monitor 703''' of FIGS. 12A2 and 12B2 are the same as the BOP monitor 703 of FIG. 10A, except that the magnets have been moved to an offset position. FIGS. 12A1 and 12B1 are schematic views of the BOP monitor 703''' of FIGS. 12A2 and 12B2. FIG. 13A shows the BOP monitor of FIG. 12A1 taken along lines 13A-13A. FIG. 13B shows the BOP monitor of FIG. 12A2 taken along lines 13B-13B.

As shown in these views, the magnets 864*a-d* are in an offset position about interior plate 868 and exterior plate 866 to translate motion therebetween. One or more pairs of magnets, such as magnets 864*a-d* as shown, may be magnetically coupled to translate rotation between the exterior plate 866 and interior plate 868.

As with the magnets depicted in the aligned position of FIG. 10A, magnets 864*a,c* on exterior plate 866 enable exterior plate 866 of FIGS. 12A and 12B to remain aligned with interior plate 868 such that the axial centerlines Z of plates 866, 868 coincide. Likewise, magnets 864*b,d* on interior plate 868 enable interior plate 868 to remain aligned with exterior plate 868 such that the axial centerlines Z of the plates 866,868 coincide. Opposing magnets 864*a,c* on exterior plate 868 and interior plate 866 closest to each other, due to their proximity, are attracted to one another.

In the offset configuration of FIGS. 12A1-12B2, magnets 864*a,c* on exterior plate 866 are radially offset from centerline Z. In the exemplary embodiment, magnets 864*b,d* on interior plate 868 may also be radially offset from centerline Z to different degrees. In other words, the radial distance Da between magnet 864*a* and centerline Z is different than the radial distance Dc between magnet 864*c* and centerline Z. In the exemplary embodiment, magnets 864*b,c* are also radially offset from centerline Z to different degrees. In other words, the radial distance between magnet 864*b* and centerline Z is different than the radial distance between magnet 864*d* and centerline Z.

The offset of the magnets 864*a-d* creates a side force between exterior plate 866 and the sensor rod 861 (or intermediate components transfer the side force to sensor rod 861). The side force is created as the offset magnets 864*a,b* try to pull each other into axial alignment. Similarly magnets 864*c,d* try to pull each other into axial alignment. The magnets 864*a-d* are offset in such a way as to cause the pull force between each set of magnets to be in the same direction. The rotation axis of exterior plate 866 and interior plate 868 and centerline of sensor rod 861 are aligned with centerline Z when the magnets are in the offset position. A hole, pocket or intermediate device in exterior plate 866 is positioned to contact sensor rod 861.

The pull force from the grouping of offset magnets acts to move exterior plate 866 away from centerline Z. The established contact with sensor rod 861 prevents exterior plate 866 from moving away from centerline Z. Exterior plate 866 will rotate in conjunction with interior plate 868 due to the magnetic attraction between 864*a,b* and 864 *c,d*. The rotation of the plates also causes the side force exerted onto sensor rod 861 to rotate which can be sensed and measured by sensor base 859. The sensed strain may then be used to determine the rotation of plate 868 and in turn the displacement and position of the ram. The relative positions of magnets 864*a,c* and magnets 864*b,d* causes a net side force thru exterior plate 866 onto sensor rod 861 shown in FIG. 12A to be in the downward direction. This side force direction will rotate with the rotation of plates 866 & 868.

As also demonstrated by FIGS. 13A and 13B, trigger sensor 857 is coupled to monitor base 851. However various sensors may be used, such that the mounting may be on the exterior cover 891, dial cover 887, or spacer 890.

Figure 14:
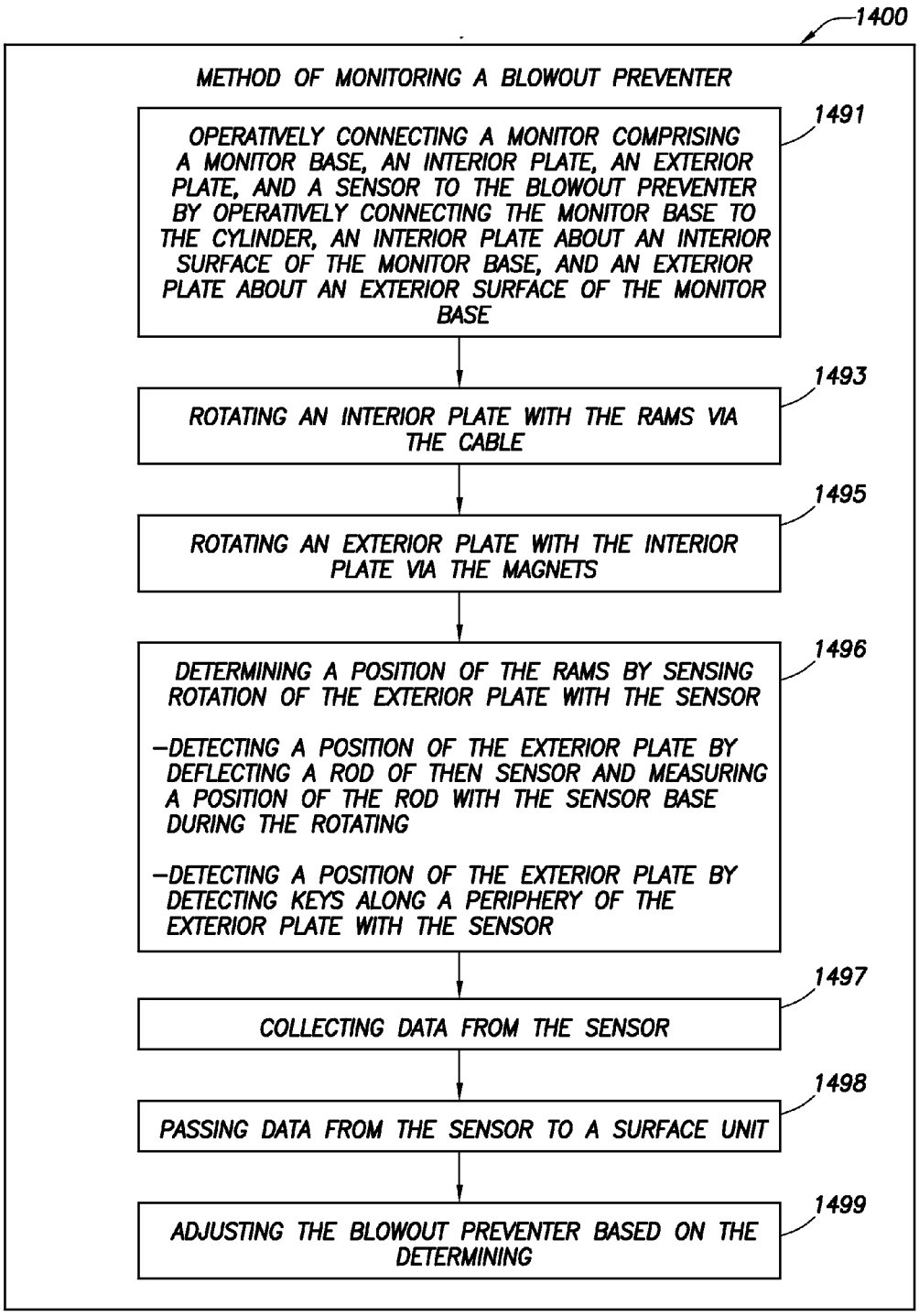
FIG. 14 is a flow chart depicting a method of monitoring a BOP.

FIG. 14 depicts a method 1400 of monitoring a position of a ram of a BOP, such as the BOPs provided herein. The method involves 1491—operatively connecting a monitor comprising a monitor base, an interior plate, an exterior plate, and a trigger sensor to the blowout preventer by operatively connecting the monitor base to the cylinder, an interior plate about an interior surface of the monitor base, and an exterior plate about an exterior surface of the monitor base, 1493—rotating the interior plate with the rams via a cable, 1495—rotating the exterior plate with the interior plate via the magnets, and 1496—determining a position of the rams by sensing rotation of the exterior plate with the trigger sensor.

The trigger sensor comprises a sensor base positionable in the monitor base and a rod extending from the sensor base into the exterior plate, and the determining 1496 may involve detecting a position of the exterior plate by deflecting the rod and measuring a position of the rod with the sensor base during the rotating. The trigger sensor may include a sensor base positionable in the monitor base and a rod extending from the sensor base into the exterior plate, and the determining 1496 may involve detecting a position of the exterior plate by detecting keys along a periphery of the exterior plate with the trigger sensor.

The method may also involve additional steps, such as 1497—collecting (or passing) data from the trigger sensor, 1498—passing data from the trigger sensor to a surface unit, 1499—adjusting the blowout preventer based on the determining. The steps may be performed in an order, and repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more monitors (with one or more sensors, pairs of magnets, and/or other components) may be positioned about one or more cylinders of a blowout preventer. Also, the monitoring devices described herein may detect positions of the piston 304 (and other portions of the ram 202) in an unactuated position, an actuated position, and/or all other positions therebetween. Various portions of the sensors, monitors, BOPs, and other devices herein may be combined.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A monitor for a blowout preventer of a wellbore, the blowout preventer comprising a housing, at least one ram slidably positionable in the housing to form a seal about the wellbore, and an actuator comprising a cylinder with a piston slidably movable therein, the piston operatively connectable with the at least one ram and movable therewith, the monitor comprising:

a monitor base operatively connectable to the cylinder, the monitor base having an interior side inside the cylinder and an exterior side outside the cylinder;

an interior plate positionable inside the cylinder about the interior side of the base, the interior plate operatively connectable to the piston and movable therewith;

an exterior plate positionable outside the cylinder about the exterior surface of the monitor base, the exterior plate coupled by magnets to the interior plate and rotatable therewith; and a trigger sensor operatively connectable about the monitor base and the exterior plate to detect rotation thereof whereby a position of the ram may be determined.

2. The monitor of claim 1, further comprising a cable operatively connecting the interior plate to the piston.

3. The monitor of claim 2, wherein the interior plate comprises a pulley wheel, the cable disposable about the pulley wheel.

4. The monitor of claim 3, wherein the interior plate further comprises a cover with a hole to pass the cable therethrough.

5. The monitor of claim 3, wherein the interior plate further comprises a rotary spring.

6. The monitor of claim 1, wherein the monitor base has an interior pocket to receive the interior plate.

7. The monitor of claim 1, wherein the monitor base has a shaft operatively connectable to the interior plate.

8. The monitor of claim 1, wherein the trigger sensor comprises a sensor base and a trigger, the sensor base operatively connectable to the monitor base and having a rod extending into the exterior plate, the trigger positionable about the exterior plate to deflect the rod to an offset position detectable by the sensor base as the exterior plate rotates whereby the position of the ram may be determined.

9. The monitor of claim 8, wherein the exterior plate has a trigger pocket therein to receive the trigger.

10. The monitor of claim 8, wherein the trigger comprises a spring and a plunger, the plunger urged by the spring against the rod.

11. The monitor of claim 8, wherein the trigger sensor comprises a bearing positionable in the exterior plate and having a hole therethrough to receive the rod, the trigger engagable with the bearing to deflect the rod.

12. The monitor of claim 8, wherein the sensor base is fixedly positioned in a sensor receptacle of the monitor base and the rod deflectingly extends from the sensor base.

13. The monitor of claim 12, wherein a rod tip of the rod extends from the sensor base into the trigger pocket, the rod tip movable in the trigger pocket as the interior plate rotates.

14. The monitor of claim 1, wherein the trigger sensor comprises a sensor base operatively connectable to the monitor base and having a rod extending to the exterior plate to detect keys along a periphery thereof.

15. The monitor of claim 14, wherein the keys comprise at least one of teeth, black and white portions, and combinations thereof.

16. The monitor of claim 1, wherein the exterior plate comprises a base plate, and the at least one ring, and a dial operatively connectable to the base plate and movable therewith.

17. The monitor of claim 1, wherein the exterior plate is rotatable via the magnets with the interior plate, the exterior plate having a dial thereon rotatable with the interior plate.

18. The monitor of claim 1, wherein the trigger sensor comprises a strain gauge.

19. The monitor of claim 1, wherein the magnets comprise interior magnets operatively connectable between the interior plate and the monitor base.

20. The monitor of claim 1, wherein the magnets comprise exterior magnets operatively connectable between the exterior plate and the monitor base.

21. The monitor of claim 1, wherein the monitor base comprises an end cap of the cylinder.

22. The monitor of claim 1, further comprising at least one seal.

23. The monitor of claim 1, further comprising an accelerometer.

24. A monitoring system for a wellbore penetrating a subterranean formation, the system comprising:

a blowout preventer positionable about the wellbore, the blowout preventer comprising:

a housing, at least one ram slidably positionable in the housing to form a seal about the wellbore, and an actuator comprising a cylinder with a piston slidably movable therein, the piston operatively connectable with the at least one ram and movable therewith, a monitor operatively connectable with the blowout preventer, comprising:

a monitor base operatively connectable to the cylinder, the monitor base having an interior side inside the cylinder and an exterior side outside the cylinder;

an interior plate positioned inside the cylinder about the interior side of the base, the interior plate operatively connectable to the piston and movable therewith;

an exterior plate positionable outside the cylinder about the exterior surface of the monitor base, the exterior plate coupled by magnets to the interior plate and rotatable therewith; and a trigger sensor operatively connectable about the monitor base and the exterior plate to detect rotation thereof whereby a position of the at least one ram may be determined.

25. The system of claim 24, further comprising an inspector.

26. The system of claim 25, wherein the inspector is one of a remote operated vehicle, an operator, and combinations thereof.

27. The system of claim 24, further comprising a controller operatively connectable to the trigger sensor.

28. A method of monitoring a blowout preventer of a wellbore penetrating a subterranean formation, the blowout preventer comprising a housing, at least one ram slidably positionable in the housing to form a seal about the wellbore, and an actuator comprising cylinders with pistons slidably movable therein, the piston operatively connectable with the at least one ram and movable therewith, the method comprising:

operatively connecting a monitor comprising a monitor base, an interior plate, an exterior plate, and a trigger sensor to the blowout preventer by operatively connecting the monitor base to the cylinder, an interior plate about an interior surface of the monitor base, and an exterior plate about an exterior surface of the monitor base; rotating the interior plate with the at least one ram via a cable;

rotating the exterior plate with the interior plate via magnets, and determining a position of the at least one ram by sensing rotation of the exterior plate with the trigger sensor.

29. The method of claim 28, further comprising collecting data from the trigger sensor.

30. The method of claim 28, further comprising passing data from the trigger sensor to a surface unit.

31. The method of claim 28, further comprising adjusting the blowout preventer based on the determining.

32. The method of claim 28, wherein the trigger sensor comprises a sensor base positionable in the monitor base and a rod extending from the sensor base into the exterior plate and wherein the determining comprises detecting a position of the exterior plate by deflecting the rod and measuring a position of the rod with the sensor base during the rotating.

33. The method of claim 28, wherein the trigger sensor comprises a sensor base positionable in the monitor base and a rod extending from the sensor base into the exterior plate and wherein the determining comprises detecting a position of the exterior plate by detecting keys along a periphery of the exterior plate with the trigger sensor.

* * * * *